United States Patent [19]

Howell, Jr.

[11] Patent Number: 4,877,091

[45] Date of Patent: Oct. 31, 1989

[54] AUGERING APPARATUS AND DRILLING RIG

[76] Inventor: Richard L. Howell, Jr., 6711 Park Ave., Garden Grove, Calif. 92645

[21] Appl. No.: 211,691

[22] Filed: Jun. 27, 1988

[51] Int. Cl.[4] ..... E21C 5/12

[52] U.S. Cl. ..... 173/89; 173/43; 173/141

[58] Field of Search ..... 173/44, 81, 89, 147, 173/149, 151, 43, 141; 175/321

[56] References Cited

U.S. PATENT DOCUMENTS

| | | | |
|---|---|---|---|
| 1,230,632 | 6/1917 | Upchurch et al. | 175/154 |
| 1,971,922 | 8/1934 | Smith | 173/44 |
| 2,480,537 | 8/1949 | Arps et al. | 255/19 |
| 2,910,274 | 10/1959 | Scott | 175/103 |
| 3,216,511 | 11/1965 | Ladd et al. | 173/19 |
| 3,307,643 | 3/1967 | Ferri | 175/161 |
| 3,426,857 | 2/1969 | Bland | 173/151 |
| 3,520,374 | 7/1970 | Ebert | 173/147 X |
| 4,035,969 | 7/1977 | Casagrande | 173/147 X |
| 4,137,974 | 2/1979 | Decker | 173/151 X |
| 4,199,033 | 4/1980 | Van Gundy, Jr. | 173/27 |
| 4,499,953 | 2/1985 | Molin | 173/43 |
| 4,627,499 | 12/1986 | Magee et al. | 173/43 |
| 4,645,084 | 2/1987 | Deike | 173/43 X |
| 4,753,468 | 8/1973 | Casagrande | 173/147 X |

FOREIGN PATENT DOCUMENTS

| | | | |
|---|---|---|---|
| 3521148A1 | 6/1985 | Fed. Rep. of Germany . | |
| 2032494 | 5/1980 | United Kingdom | 173/147 |

OTHER PUBLICATIONS

Champion Equipment Co. catalog on Augers & Drilling Tools, pp. 16 & 17.

Traddrill Inc. brochure for Tracdrill TD 120.

Hughes Tool Co. brochure for Hughes Hydra-Digger, brochure No. 5M 1176 G&E.

Texoma Inc. brochure for Texoma 500.

Hughes Tool Co. brochure No. 5M379WLC for Hughes Hydra-Digger.

Dunham Mfg. Co. Inc. leaflet for Dunham Teague AF430 Digger.

Hugh B. Williams Mfg. Co. brochure for Williams MF Foundation Digger for medium duty construction.

Hugh B. Williams Mfg. Co. brochure for Williams Crawler-Mounted Hole Diggers for models TADH, TBDN, TMDH and TLDH.

Hugh B. Williams Mfg. Co. brochure for Williams ADH Standard Digger, the pole line and material exploration digger.

Hugh B. Williams Mfg. Co. brochure for Williams LDH Foundation Digger E/Z Bore, Inc. leaflet for Model 90 Boring Rig.

Calweld, Division of Smith International Inc. brochure No. C1-70-1186 Calweld Drilling and Tunneling Equipment—Bucket Drills.

Earthdrill Ltd. bulletin No. LH-177 for Calweld LH Series Models 32-42-45-52 Heavy-Duty Type Drilling Machines.

Hugh B. Williams Mfg. Co. brochure for Williams LLDH Foundation Drilling Machine, designed for heavy construction drilling.

*Primary Examiner*—Frank T. Yost

*Assistant Examiner*—James L. Wolfe

*Attorney, Agent, or Firm*—F. Eugene Logan

[57] ABSTRACT

A downcrowdable telescopic augering apparatus and drilling rig is disclosed that has a low overhead requirement and yet can drill large diameter holes ot great depths. The invention is especially useful for drilling foundation holes. One embodiment of the invention can ready over walls and in-place equipment for drilling holes. One embodiment of the invention can drill holes at almost any angle desired into the earth. One embodiment can drill holes on steeply inclined terrains. Because of its low overhead requirement, the drilling rigs of this invention can be used inside existing building without damaging the ceilings or roofs to drill foundation holes for mounting new machinery. The downcrowd means of this invention does not substantially increase the height of the augering apparatus or drilling rig.

32 Claims, 9 Drawing Sheets

FIG. 1.
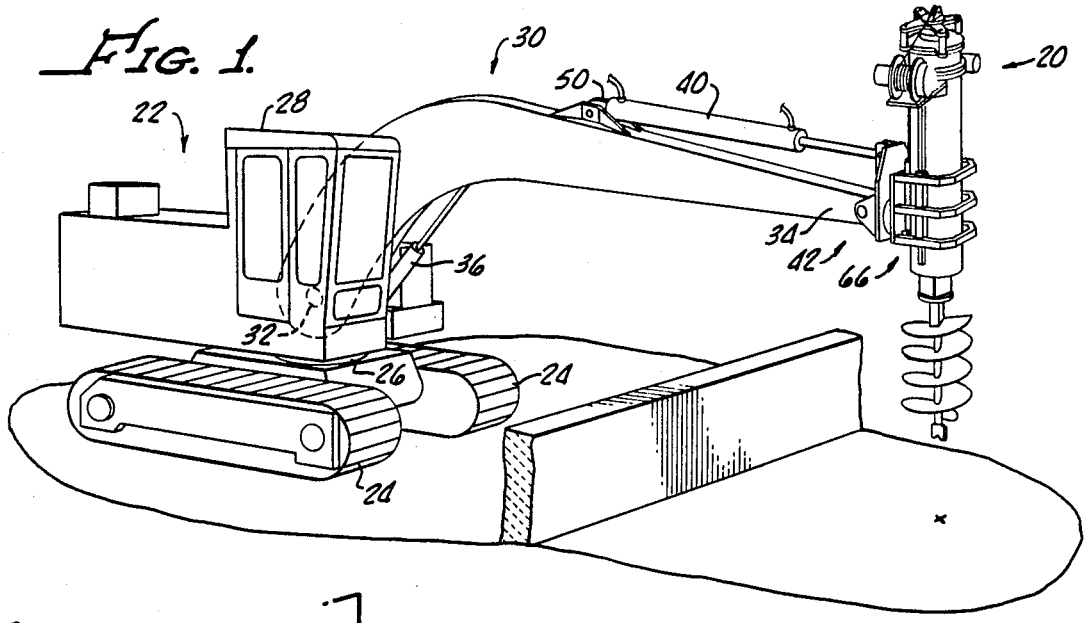
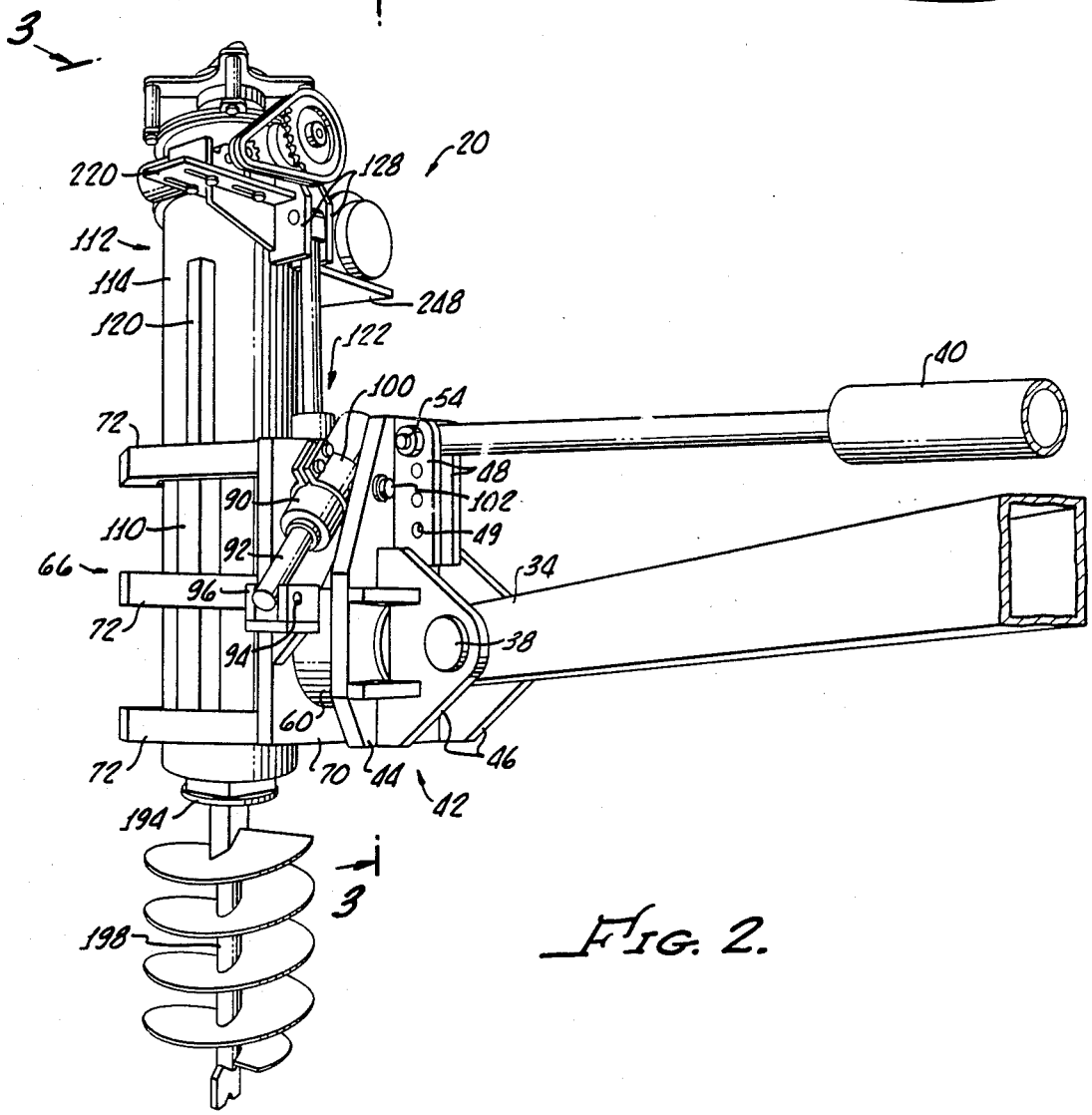
FIG. 2.

66
112
176
182
198
260
262

66
112
198
199
264

66
112
176
182
188
164
198
138
197
199

66
112
176
182
188
164
198

66
112
176
182
188
164
198

AUGERING APPARATUS AND DRILLING RIG

BACKGROUND OF THE INVENTION

1. Field of the Invention

The present invention relates to earth excavating equipment and particularly to machines for drilling holes into the earth. More particularly the invention concerns heavy duty mobile devices for drilling large holes such as six foot or larger diameter foundation holes which are relatively deep such as twenty feet or deeper holes.

2. Discussion of the Relevant Art

There are many types of drilling rigs available for drilling holes into the ground. Some of the commercially available drilling rigs are more useful than others. Some drilling rigs are designed primarily for one type of usage and are not very useful, or in some cases not useful at all, for other uses. For example, U.S. Pat. No. 4,645,084 discloses a device which will drill holes at a variety of angles, however the device as illustrated is mounted on a truck and is light weight and would not be suitable for drilling large diameter holes, or deep holes, or holes on a steeply inclined terrain.

U.S. Pat. No. 1,971,922 discloses a drilling apparatus that is suspended by cable from the end of a crane. The weight of the telescopic kelly sections, auger and electric motor used to drive the kelly sections assist in forcing the auger into the ground. Power downcrowding is not possible with this apparatus.

U.S. Pat. No. 4,199,033, which is hereby incorporated herein by reference, discloses a device which as illustrated, is mounted on the arm or boom of a backhoe. This device is shown drilling holes into the earth at a variety of angles. While this device appears to be capable of drilling medium diameter holes, it does not appear to be capable of drilling large diameter holes or relative deep holes at least without a great deal of difficulty. The device, however, can be power downcrowded by the boom of the backhoe; however, the movement would require complicated control of several hydraulic cylinders simultaneously even for vertical holes that would be difficult for the operator. Holes drilled at an angle would require even more complicated control to the degree that it would not appear to be practical to use this device for such excavations.

U.S. Pat. No. 2,910,274 discloses an expandable bucket device for digging bell-shaped holes for footings which is connected by cable to the end of the boom of a crane. Although this device appears to be capable of drilling relatively large diameter holes it appears that only vertically oriented holes are possible since the weight of the drill stem and excavating bucket appear to be the only force bearing on the bucket to drive the bucket into the ground. The device is limited in drilling depth by the length of a vertical column depending from the free end of the boom.

U.S. Pat. No. 4,627,499, which is hereby incorporated herein by reference, discloses perhaps a more useful drilling device for drilling foundation holes which is mounted on the end of a boom on a track type vehicle having a rotatable turnable. The drilling device is of the drill mast type and involves a single kelly bar driven by a final drive which is pivotally mounted to the boom at the bottom of the drill mast. While the drilling rig disclosed in U.S. Pat. No. 4,627,499 is perhaps more useful than the others it is limited to a single kelly. The depth of the hole is therefore limited by the length of the kelly bar which is in turn limited by the height of the drill mast as are all drilling devices which use a drill mast of the type illustrated in the patent. Thus while relatively deep holes can be drilled with devices using a drilling mast to do so requires a long mast which limit the usefulness of such devices in environments which require a low overhead clearance.

U.S. Pat. No. 3,216,511, which is hereby incorporated herein by reference, discloses a crawler type vehicle having tracks, a turntable and boom having a distal end.

What is needed is a heavy duty augering apparatus which can be power downcrowded and can drill large diameter holes to great depths with relatively little overhead requirements. What would be even more useful would be for such an apparatus to be adaptable for mounting on a large variety of vehicles thereby producing a variety of drilling rigs. It would also be useful if such an augering apparatus could be tilted in all directions. It would be particularly useful if such an augering apparatus were mountable on the free end of a boom-containing vehicle.

It would be especially useful for such an augering apparatus to be adaptable to a vehicle having a telescopic boom, mounted on a turntable with crawler type tracks thereby forming a drilling rig that can be used on steeply inclined terrains, that can easily position the augering apparatus over a preselected drill site at any desired axial angle of orientation into the ground, that can reach over walls or other in-place large machines or other obstacles and drill holes without removing such things, and that can be used in environments with low overhead while still being capable of drilling large diameter holes to great depths. It would also be beneficial if such a drilling rig were readily transportable on a flat bed trailer with a total height that would allow it to pass underneath bridges and that when removed from the trailer would be in a state ready for immediate use without the need to assemble components together before the drilling rig can be used.

SUMMARY OF THE INVENTION

It is an object of this invention to provide an augering apparatus which requires relatively little overhead clearance and which can drill relatively deep holes into the earth.

It is another object of this invention to provide an augering apparatus which can be power downcrowded to speed drilling into the earth.

It is a further object of this invention to provide an augering apparatus which can drill holes at any angle into the earth.

Still another object of this invention is to provide an augering apparatus which has a telescopic drill stem so that relatively deep holes can be drilled into the earth.

It is also an object of this invention to provide an augering apparatus which can drill 6 foot and 7 foot or larger diameter holes into the earth.

Yet another object of this invention is to provide an augering apparatus which is high powered and can increase the rate of drilling a hole into the earth.

Still another object of this invention is to provide an augering apparatus which is relatively easy to position over a preselected drill site.

A further objective of this invention is to provide an augering apparatus which has a top mounted rotary final drive which can be downcrowded.

It is another object of this invention to provide an augering apparatus that can reach over walls and machinery or other obstacles without removal of such obstacles and drill holes into the earth.

Still another object of this invention is to provide an augering apparatus which can be mounted on a boom. A further object is to provide an augering apparatus which can be mounted on the free end of a boom of an excavator.

It is yet another objective of this invention to provide an augering apparatus which can be used on, and is stable on, steeply inclined slopes to drill holes into the earth without the use of outriggers for stability.

Another objective of this invention is to provide an augering apparatus which can quickly reposition the auger to a dirt dump site, quickly dump the dirt, and quickly return to the drill site for drill the same hole to a deeper depth.

Still another object of this invention is to provide an augering apparatus which can be easily transported on the highways and under bridges on a flat bed trailer without being disassembled and which can be immediately used without field assembly for drilling holes into the earth.

It is also an object of this invention to provide an augering apparatus which can be adapted to a variety of vehicles, including but not limited to mobile drilling rigs adapted for drilling foundation holes and the like for use at construction sites or for drilling telephone post holes on steeply inclined terrains without the need for outriggers and like devices for stabilizing the drilling rig.

Accordingly, there is provided by the principles of this invention a downcrowdable telescopic augering apparatus for drilling a hole in the surface of the earth comprising cradle means having a longitudinal central cavity; housing means having a cylindrical inside surface which defines a torque axis, the longitudinal central cavity of the cradle means for receiving the housing means; means for permitting slidable displacement of the housing means relative to the cradle means in, and restricted to, a predetermined straight line direction in axial alignment with the torque axis; downcrowd means for downcrowding the housing means relative to the cradle means in the predetermined straight line direction; torque transmission means rigidly attached to the reaction torque housing means, the torque transmission means adaptable for receiving torque from a source of rotary power along an input power axis at an angle to the torque axis and transmitting torque in axial alignment with the torque axis; telescopic kelly means having a plurality of telescoping kelly sections, the kelly means being rotatably mounted in the housing means for rotation about the torque axis thereof, the kelly means having a bottom part adaptable for coupling to an auger; and torque coupling means for transmitting torque from the torque transmission means to the kelly means; and means for retracting the kelly means into the reaction torque housing means. In one embodiment the downcrowd means does not substantially increase the vertical height of the augering apparatus when the apparatus is used to drill a vertical hole.

In another embodiment there is provided by the principles of this invention a downcrowdable telescopic augering apparatus for drilling a hole in the surface of the earth, the augering apparatus intended for rigid attachment to a holding means operable for positioning and maintaining during drilling the augering apparatus at a predetermined spatial location and drilling axial orientation proximate a preselected drill site to be drilled with said augering apparatus. The augering apparatus comprises a means having an open-ended main frame which has a longitudinal central cavity, and receptacle means rigidly attached to the main frame; and reaction torque housing means having a principal body which has a cylindrical inside surface which defines a torque axis, and guide means rigidly fastened longitudinally on outside of the principal body. The cradle means is operable for receiving in the longitudinal central cavity thereof the housing means. The guide means and the receptacle means of the cradle means are operable for permitting slidable displacement of the housing means relative to the receptacle means such that the slidable displacement is in, and restricted to, a predetermined straight line direction which is in axial alignment with the torque axis.

The augering apparatus also comprises downcrowd means connected to the housing means and the cradle means, such that a predetermined amount of movement of the downcrowd means causes a predetermined amount of straight line displacement of the housing means relative to the cradle means in a direction in axial alignment with the torque axis, the downcrowd means having a predetermined maximum downcrowd length.

Rigidly attached to the top of the principal body of the reaction torque housing means is a torque transmission means or final drive means. The torque transmission means is operable for receiving torque along an input power axis at an angle to the torque axis and transmitting torque along an axial torque transfer channel extending axially through the torque transmission means in axial alignment with the torque axis.

The augering apparatus further comprises telescopic kelly means having a plurality of telescoping kelly sections which comprise at least an outermost kelly section and an innermost kelly section. The telescopic kelly means is operable for being extended to a predetermined maximum telescopic length beyond the reaction torque housing means. The reaction torque housing means is operable for rotatably mounting therein the outermost kelly section for rotation about the torque axis of the housing means. Except for the innermost kelly section each one of the kelly sections is operable for rotating an inwardly adjacent kelly section, and each one of the kelly sections has an axis in axial alignment with the torque axis. The bottom part of the innermost kelly section is adaptable for coupling to an auger.

The augering apparatus still further comprises torque coupling means rigidly connected to the torque transmission means and to the outermost kelly section of the telescopic kelly means. The torque coupling means is operable for transmitting torque along the torque axis received from the torque transmission means to the outermost kelly section. The torque coupling means has an upper part which is received in and rigidly connected to the torque transfer channel of the torque transmission means and a lower part that is rigidly connected to an upper part of the outermost kelly section. The torque coupling means also has a coupling bore having an axis in axial alignment with the torque axis of the reaction torque housing means.

In one embodiment of this invention the augering apparatus also comprises torque generator means for producing rotary power; torque transfer means for transferring rotary power produced by the torque generator means to the torque transmission means; and flexible tension means swivelly connected at one end thereof to the innermost kelly section and connected at an opposite end thereof to winch means. The flexible tension means is operable for freely passing through the coupling bore of the torque coupling means. The winch means is operable for winching up the flexible tension means and for retracting the plurality of kelly sections into the reaction torque housing means. The augering apparatus is also operable for extending an auger attached thereto for a longitudinal distance along the torque axis approximately equal to the sum of the maximum downcrowd length and the maximum telescopic length.

In a further embodiment of this invention, the principal body of the reaction torque housing means is elongated and the guide means extends from proximate the top of such elongated principal body to proximate the bottom thereof.

In another embodiment of this invention the transmission means has a transmission housing which is rigidly attached to the top of the principal body of the reaction torque housing means and angle drive means rotatably mounted in the transmission housing. The angle drive means has an output power axis in axial alignment with the torque axis and an input power axis at an angle to the output power axis. The axial torque transfer channel extends through the angle drive means. The transfer means for transferring rotary power produced by the torque generator means transfers power to the angle drive means along the input power axis. In a still further embodiment, the angle drive means of the torque transmission means is right angle drive final drive means.

In a still further embodiment of this invention the angle drive means has an output gear means which is driven by an input gear means, the torque transfer channel is in the output gear means, and torque transfer means drives the input gear means.

In yet another embodiment of this invention the torque coupling means is operable for maintaining the outermost kelly section rotatably mounted in the reaction torque housing means.

In another embodiment of this invention, the telescopic kelly means has a kelly bearing rigidly attached to the outside of the outermost kelly section which is rotatably mounted in the cylindrical inside surface of the reaction torque housing means.

In yet another embodiment of this invention, the winching means is rigidly attached to the reaction torque housing means.

In a further embodiment of this invention, the augering apparatus further comprises holding means for rigidly positioning and maintaining during drilling the cradle means at a predetermined spatial location and predetermined orientation of the torque axis of the reaction torque housing means.

In one embodiment of this invention, the downcrowd means of the augering apparatus comprises a hydraulic cylinder. In another embodiment one end of the downcrowd means is connected to the principal body of the housing means and the opposite end of the downcrowd means is connected to the main frame of the cradle means.

In another embodiment of this invention, the plurality of kelly sections of the augering apparatus telescope by gravity. In other embodiments the telescopic kelly means when telescoped and rotating is operable while drilling a hole into the surface of the earth for preventing the telescopic kelly means from being retracted into the reaction torque housing means.

In still another embodiment of this invention, each section of the plurality of telescoping kelly sections of the kelly means has a square external periphery. In further embodiment, the innermost kelly section has a square cross section and all other kelly sections have a square tubular cross section. In a still further embodiment the axial torque transfer channel of the torque transmission means has a square internal periphery, and the upper part of the torque coupling means which is received in the torque transfer channel has a square external periphery. In yet another further embodiment the lower part of the torque coupling means has a square periphery which is received internally in, and in abutting relationship with, the upper part of the outermost kelly section.

In still another embodiment of this invention, the torque generator means of the augering apparatus has a frame which is rigidly attached to the reaction torque housing means. In yet another embodiment the torque generator means is hydraulic fluid powered.

In yet another embodiment of the augering apparatus of this invention the flexible tension means is a cable. The winch means comprises a pulley assembly means swivelly mounted on a spacer member which is rigidly mounted to and extends above the torque transmission means. The winch means further comprises a motorized winch having a spool operable for spooling up the cable. The cable rides on the pulley means, which is operable for swiveling relative to the spacer member, so that the cable rides centrally in the coupling bore of said coupling means for all positions of the cable on the spool.

In yet a still further embodiment of this invention, the augering apparatus is adaptable for attachment to the distal end of a boom of an earth excavating machine which is operable for azimuthal and elevational positioning of the distal end of said boom. The distal end has a main pin traverse to the boom for pivotal attachment of an earth excavating device. The machine also has longitudinal tilt hydraulic cylinder means for pivoting of such device in the plane of the boom about the main pin of the boom. In this embodiment the augering apparatus further comprises yoke means having a main body, longitudinal bearing means rigidly attached to the main body for pivotally connecting to the main pin of the boom, tilt bearing means rigidly attached to the main body for pivotally connecting to the longitudinal tilt hydraulic cylinder means such that a predetermined amount of extension of the longitudinal tilt hydraulic cylinder means causes a predetermined amount of pivoting of the yoke means in the plane of the boom about the main pin of the boom, and traverse bearing means rigidly attached to the main body for pivotally connecting the cradle means. In this embodiment the cradle means also has traverse trunnion means rigidly attached to the main frame for pivotally connecting to the traverse bearing means of the yoke means, the traverse trunnion means and the traverse bearing means being operable for permitting the cradle means to be pivoted in a plane perpendicular to the plane of the boom, and receptacle means rigidly attached to the main frame for pivotally connecting to traverse tile hydraulic cylinder means. The traverse tilt hydraulic cylinder means is for controlled pivoting of the cradle means relative to the yoke means in a plane perpendicular to the plane of the boom.

In a further embodiment of the augering apparatus of this invention the traverse tile hydraulic cylinder means is pivotally connected at an opposite end thereof to the yoke means, such that a predetermined amount of extension of the traverse tilt hydraulic cylinder means causes a predetermined amount of pivoting of the cradle means relative to the yoke means. In a further embodiment the one end is pivotally connected to the main frame of the cradle means and the opposite end is pivotally connected to the main body of the yoke means. In another embodiment the traverse tilt hydraulic cylinder means and the downcrowd hydraulic cylinder means each comprise a double acting hydraulic cylinder and three-way or three-position hydraulic central valve.

In still another embodiment of this invention the augering apparatus is mounted on the distal end of a boom of an earth excavating machine. In a further embodiment the boom is operable for azimuthal and elevation positioning. In another embodiment the boom is extendible in the horizontal direction. In yet another embodiment the excavating machine is a crawler type vehicle having tracks for maneuvering on steeply inclined terrain.

The vehicles and booms disclosed in U.S. Pat. Nos. 3,216,511 and 4,199,033 and 4,627,499 are useful for mounting the augering apparatus of the present invention.

Other and further objects, embodiments and advantages of this invention will be apparent to those skilled in the art from the consideration of the following description of this invention.

BRIEF DESCRIPTION OF THE DRAWINGS

FIG. 1 is a front, top and left side perspective view of the downcrowdable telescopic augering apparatus of this invention attached to the distal end of a boom of an excavator and is shown reaching over a wall to a preselected drilling site.

FIG. 2 is a rear and right side perspective view of the augering apparatus of FIG. 2 showing the two hydraulic cylinders used to orient the drilling axis of the auger and the top part of the hydraulic cylinder used to downcrowd the auger.

DESCRIPTION OF THE PREFERRED EMBODIMENT

Figure 3:
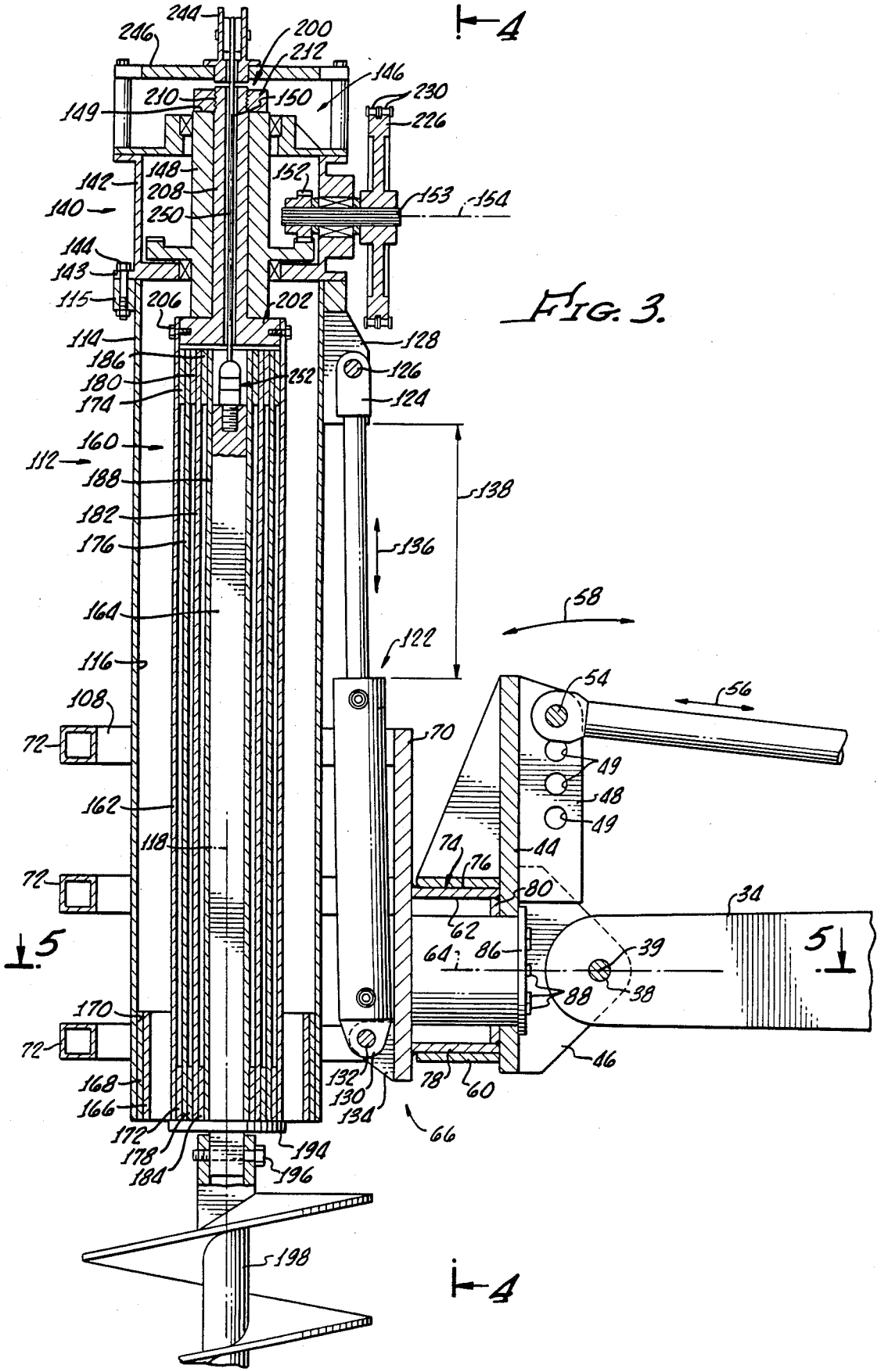
FIG. 3 is a right side elevational view in cross section as seen through line 3—3 of FIG. 2.

A downcrowdable telescopic augering apparatus of this invention is indicated generally by reference number 20 in FIGS. 1 and 2. In the illustrated embodiment, the augering apparatus is firmly supported by a vehicle indicated generally by reference numeral 22. Vehicle 22 preferably is a crawler type vehicle such as an excavator having track crawling carriage means 24 and rotatable turntable means 26. Mounted on turntable means 26 are operator cab 28 and angular boom means indicated generally at 30. Boom means 30 is pivotally attached to turnable means 26 by horizontal base pin 32. Elevation of distal end 34 of boom means 30 is controlled elevational hydraulic cylinder means 36. Boom means 30 further comprises distal end horizontal main pin 38 having axis 39, as best shown in FIG. 5, and longitudinal tilt hydraulic cylinder means 40.

Yoke means indicated generally at 42 comprises main body member 44 to which is rigidly connected preferably by welding longitudinal bearing means 46 and tilt bearing means 48. Bearing means 46 preferably is adapted to fit around the vertical side surfaces of distal end 34 of boom means 30. Yoke means 42 is pivotally mounted by main pin 38 which passes through bearing means 46 and distal end 34 of boom means 30. One end, 50, of hydraulic cylinder means 40 is pivotally connected to boom means 30 away from distal end 34, and an opposite end, 52, of means 40 is pivotally connected by horizontal pin 54 to bearing means 48 using one of holes 49. It can be appreciated that a predetermined amount of extension or retraction, as represented by arrow line 56 of FIG. 3, of cylinder means 40 will effect a predetermined amount of pivoting of yoke means 42 forwardly or aftwardly about pin 38 in the vertical plane of boom means 40 as represented by arcuate arrow line 58 of FIG. 3. FIG. 3 is a cross-sectional side elevational view of the augering apparatus taken through the vertical plane of boom means 30. Preferably cylinder means 40 has sufficient extension that the augering apparatus can be positioned horizontally under boom means 30, that is so that main body member 44 lies horizontally under distal end 34. In one embodiment of this invention, with the augering apparatus in the horizontal position, the entire drilling rig, that is augering apparatus 20 and vehicle 22 can be transported on a flat low bed trailer and have a combined height that will not exceed about 17 feet thereby enabling the drilling rig to pass under most bridges and overpasses.

Figure 5:
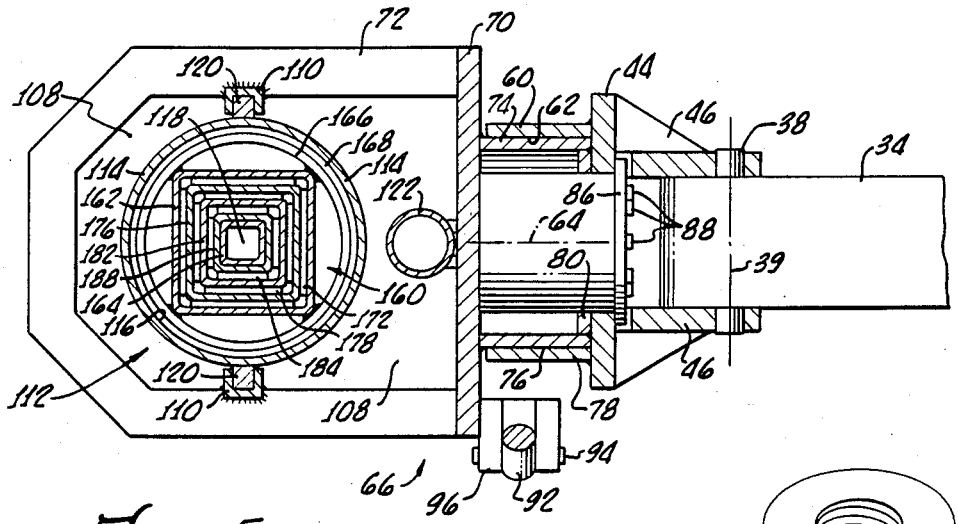
FIG. 5 is a top view in cross section taken through line 5—5 of FIG. 3 showing the concentric arrangement of the several kelly sections and the pivotal connection for transverse pivoting of the cradle means relative to the yoke means.

Also rigidly attached, preferably by welding, to main body member 44 is traverse bearing means 60 which is most clearly shown in FIGS. 3 and 5. Traverse bearing means 60 is preferably a heavy wall annulus having inside cylindrical surface 62 having axis 64 which is perpendicular to member 44. Preferably axis 64 intersects axis 39 and is perpendicular thereto as most clearly shown in FIGS. 3 and 5.

Pivotally connected to yoke means 42 is cradle means 66 which comprises open-end main frame 68 which comprises base plate member 70 and U-shaped member 72 which are rigidly attached, preferably by welding, to member 70. Traverse trunnion means 74 has external cylindrical surface 76 adapted to be received in cylindrical inside surface 62 of bearing means 60. In the embodiment shown in FIG. 5, trunnion means 74 comprises annular member 78 which is rigidly attached, preferably by welding to plate member 70. Rigidly attached, to member 78, preferably by welding, is ring member 80. To add strength to trunnion means 74, means 74 further comprises solid core member 82 rigidly attached to ring member 80, preferably by welding. Core member 82 abuts plate member 70 and is preferably rigidly attached thereto by welding and/or by bolts. Circular retaining plate 86, which can be split into two semicircular halves for facilitating assembly, is rigidly attached by bolts 88 to core member 82 thereby pivotally connecting trunnion means 74 of cradle means 66 to traverse bearing means 60 of yoke means 42. As can be seen in FIG. 5, cradle means 66 is therefore permitted to pivot in a plane perpendicular to the vertical plane of boom means 30, that is in a left to right or traverse plane.

Figure 4:
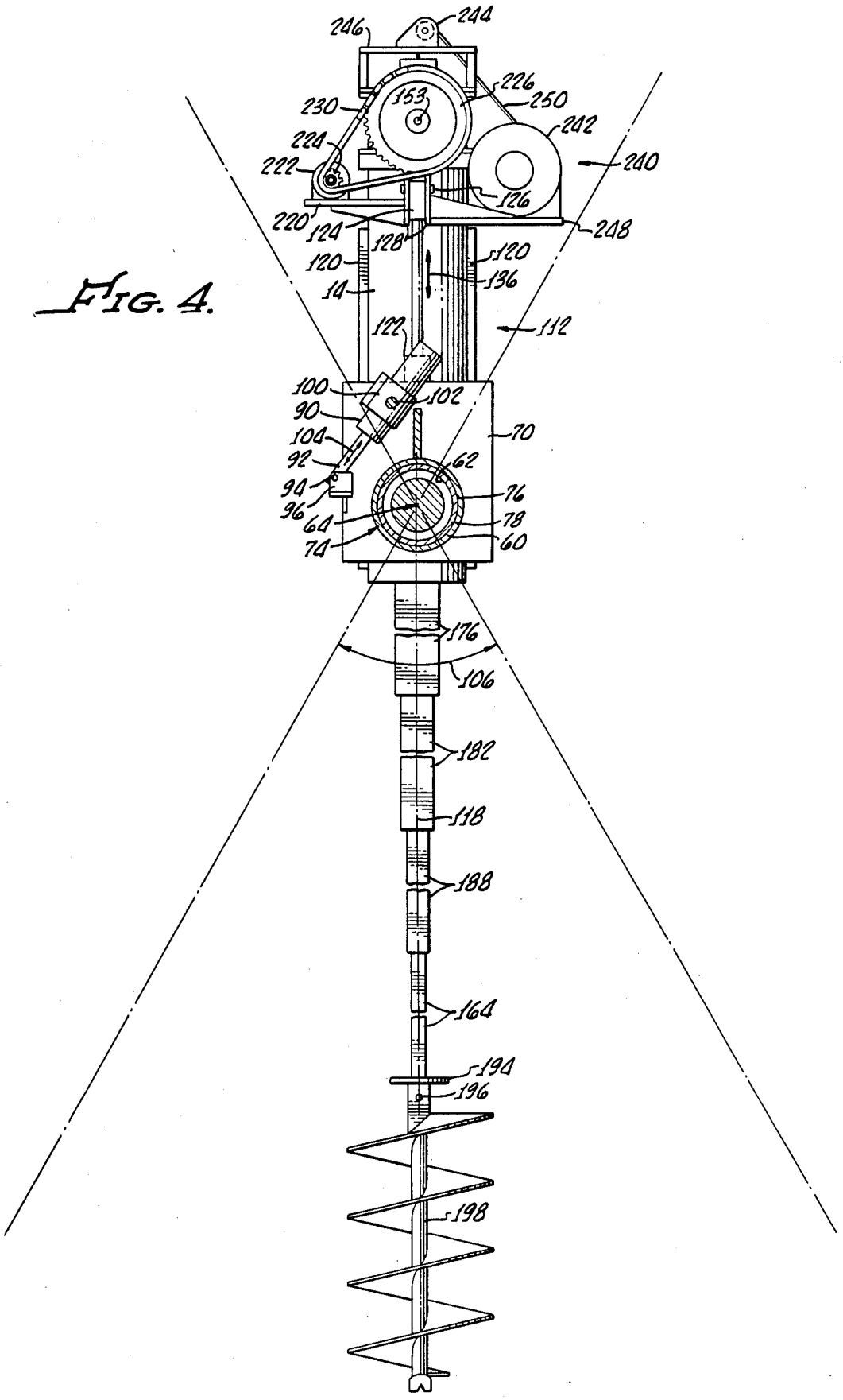
FIG. 4 is a rear elevational view taken through line 4—4 of FIG. 3 showing telescoped kelly sections and the traverse or right to left tilt hydraulic cylinder.

Traverse tile hydraulic cylinder means 90, shown best on FIGS. 2 and 4, is pivotally connected at end 92 thereof to pin 94 which is connected to bracket 96 which is rigidly connected, preferably by welding, to plate member 70 of cradle means 66. Opposite end 98 of cylinder means 90 is rigidly attached to annular strap means 100 which is rigidly attached, preferably by welding, to pin 102 which is pivotally connected to main body member 44 of yoke means 42. It can be seen from the figures that a predetermined amount of extension or retraction, as represented by arrow line 104 in FIG. 4, of cylinder means 90 will effect a predetermined amount of traverse pivoting of cradle means 66 to the left or right about axis 64 of cylindrical inside surface 62 in a plane perpendicular to the vertical plane of boom means 30 as represented by arcuate arrow line 106 of FIG. 4. Open-ended main frame 68 of cradle means 66 forms between U-shaped members 72 and plate member 70 longitudinal central cavity 108. Rigidly attached to members 72 and contained in cavity 108 is receptacle means 110 which is preferably attached to members 72 by welding. Also contained in cavity 108 and slidably coupled to receptacle means 110 is reaction torque housing means 112. In one embodiment cradle is operable for traverse tilting at least about 30° off of vertical.

Housing means 112 preferably has an elongated principal body 114 having a cylindrical inside surface 116 which defines torque axis 118 as best seen in FIGS. 3 and 5. Elongated principal body 114 preferably is also cylindrical on its outside elongated surface as shown in FIG. 5. Guide means 120 is rigidly attached longitudinally to the outside of body 114, preferably by welding, and extends longitudinally from proximate the top to proximate the bottom of body 114. Preferably guide means 120 comprises at least two rails diametrically opposing on the left and right side of tubular body 114. Guide means or rails 120 are slidably received in receptacle means 110. Preferably receptacle means 110 is a pair of opposing C-shaped channels in which rails 122 can slide. As can be seen from FIGS. 2 and 5, slidable displacement of guide means 120 relative to receptacle means 110 is restricted to a predetermined straight line direction parallel to torque axis 118, and as a consequence slidable displacement of housing means 112 relative to cradle means 66 is in axial alignment with torque axis 118.

Controlled slidable displacement of housing means 112 relative to cradle means 66 is effected by downcrowd hydraulic cylinder means 122 which is best seen in FIG. 3. Upper end 124 of downcrowd means 122 is pivotally connected to pin 126 which is connected to bracket 128 which is rigidly attached, preferably by welding, to principal body 114 of housing means 112. An opposite end 130 of downcrowd means 122 is pivotally connected by pin 132 to bracket 134 which is rigidly attached, preferably by welding, to plate member 70 of cradle means 66. With reference to FIG. 3 it can be seen that a predetermined amount of extension or retraction of downcrowd means 122, as represented by arrow line 136, will effect a predetermined amount of downcrowding of housing means 112 relative to cradle means 66. It can also be seen that downcrowd direction 136 is parallel to torque axis 118. Downcrowd means 122 has a maximum downcrowd stroke length represented by arrow line 138. Control means 40, 90 and 122 are preferably double acting hydraulic cylinders which are controlled by an operator with conventional hydraulic control valves housed in cabin 28.

Mounted to the top of housing means 112 is torque transmission means generally indicated by numeral 140. Means 140 comprises transmission housing 142 having flange 143 rigidly attached, preferably by welding, to the lower distal end of means 140. Flange 143 is rigidly attached, preferably by bolt fastener means 144, to flange 115 which is rigidly attached preferably by welding to the upper distal end of tubular body 114. Transmission means 140 further comprises angle drive means, generally indicated by numeral 146, rotatably mounted in housing 142. Angle drive means 146 comprises output gear means 148 having an output power axis 150 in axial alignment with torque axis 118 of housing means 112, and input gear means 152 having input power axis 154 which is at an angle to axis 150. Preferably drive means 146 is a right angle drive. Output gear means 148 has axial torque transfer channel 156, which preferably has a square internal periphery, extending axially therethrough for receiving torque coupling means as will be explained later. Non-limiting examples of torque transmission means 140 are rotary tables such as the self-contained rotary table made from the ring gear and pinion from the F-800 Ford Motor Co. truck or a similar unit of a TD-24 International Harvester heavy duty tractor.

Rotatably mounted inside housing means 112 is telescopic kelly means generally indicated by numeral 160. Kelly means 160 comprises a plurality of kelly sections which comprise at least an outermost kelly section 162 and an innermost kelly section 164. Rigidly attached to the bottom outside part of section 162 is bearing 166. Bushing 168 is press fitted into recess 170 in the lower distal end of tubular body 114 to provide a highly precision inside cylindrical surface for bearing 166 to rotate. In the embodiment of this invention shown in FIG. 3, kelly means 160 further comprises retainer 172 rigidly attached to the inside lower distal end of outermost kelly section 162, retainer 174 rigidly attached to the outer upper distal end of second kelly section 176, retainer 178 rigidly attached to the inside lower distal end of section 176, retainer 180 rigidly attached to the outer upper distal end of third kelly section 182, retainer 184 rigidly attached to the inside lower distal end of section 182, and retainer 186 rigidly attached to the outer upper distal end of fourth kelly section 188. In the embodiment shown in FIG. 3 the kelly sections, except for outermost section 162, telescope by gravity under their own weight when kelly means 160 is not rotating. Sections 176, 182, 188 and 164 telescope as an unit until upper retainer 174 abuts lower retainer 172. Next sections 182, 188 and 164 telescope as an unit until upper retainer 180 abuts lower retainer 178. Then sections 188 and 164 telescope as an unit until upper retainer 186 abuts lower retainer 184. Lastly innermost section 164 telescopes until stopped by cable 250 at which point the kelly means is fully telescoped. Preferably about one foot of solid kelly section 164 remains in adjacent kelly section 188 at the point of maximum telescopic length. Since there are no retainer plates on innermost kelly section 164, in the embodiment shown in FIG. 4, it can be easily removed if desired to replace cable 250 or swivel 252. Preferably the upper and lower retainers are attached to their respective kelly sections by welding.

Rigidly attached, preferably by welding, to the bottom part of innermost kelly section 164 is lift plate 194. After kelly means 160 has telescoped, either partially or fully, innermost section 162, section 162 is retracted into tubular body 114. Lift plate 194 abuts the lower distal end of sections 188, 182 and 176, in that order, and lifts such sections in their retracted configuration back into outermost kelly section 162. Also attached to the distal end of innermost section 164 and below lift plate 194 is coupling means 196 for coupling of auger 198.

In the preferred embodiment of this invention shown in the figures, innermost kelly section 164 has a solid square cross section and section 162, 176, 186 and 188 have a square tubular cross section as best seen in FIG. 5. Lower retainers 172, 178 and 184 are shown on the inside surface of kelly sections 162, 176 and 182, respectively. As shown, it is not necessary for the retainers to extend around the inside or outside corners of the kelly sections. It can be appreciated that as outer section 162 rotates all other kelly sections are required to rotate. Although all kelly sections rotate, only inner sections 176, 182, 188 and 164 are permitted to telescope; that is outermost section 162 does not telescope but is retained inside tubular body 114 at all times as will be more fully explained below. It can be seen that the axes of the kelly sections and auger 198 coincide with the axis of tubular body 114 and bushing 168. The width and thickness of the kelly sections and diameter of tubular body 114 have been increased in FIGS. 4 and 5 to clearly show the relationship of these components to each other. For example in one embodiment of this invention the outside diameter of body 114 is about 41 centimeters (41 cm) and the outside diameter of traverse bearing means 60 is about 51 cm. The diameter of torque transmission means or rotary table means 140 has also been increased in the figures for more clearly showing the relationship of their components.

Figure 7:
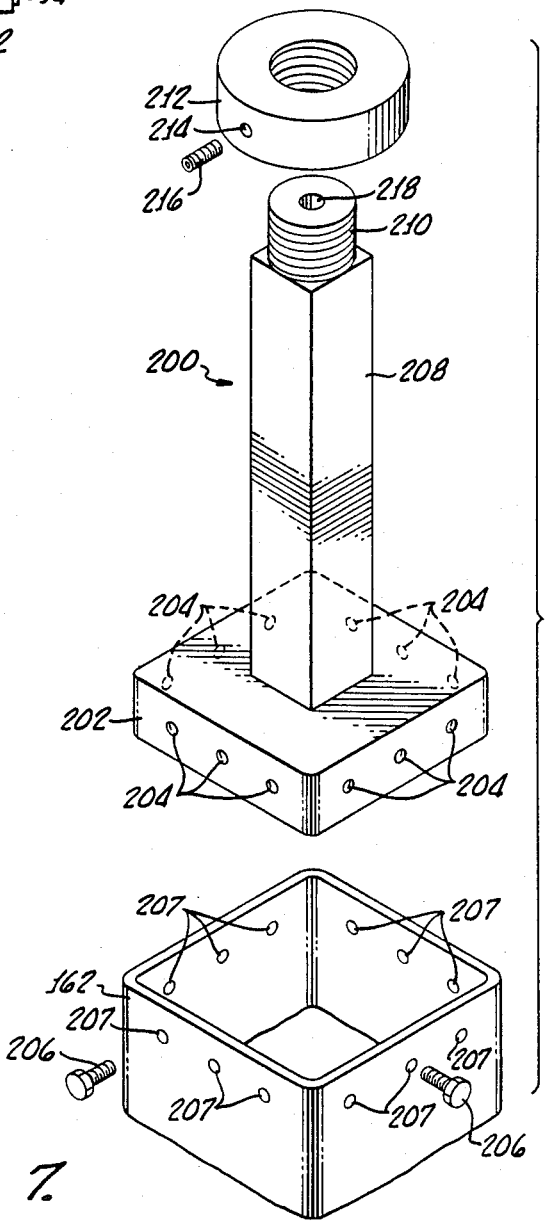
FIG. 7 is a front, top and right side perspective view of the preferred embodiment of the torque coupling means of this invention.

Telescopic kelly means 160 is coupled to output gear means 148 of torque transmission means 140 by torque coupling means generally indicated by numeral 200 as seen best in FIGS. 3 and 7. In particular lower part 202 of coupling means has an enlarged square outer periphery adapted to be received in abutting relationship inside the upper distal end of outermost kelly section 162. Leading in from the vertical face of lower part 202 are a plurality of internally threaded holes 204 which are aligned with a corresponding number of holes 207 in the upper end of section 162 through which bolts 206 are tightened thereby rigidly connecting kelly means 160 to coupling means 200.

Square columnar upper part 208 is adapted to be received in abutting relationship inside square internal peripheral axial torque transfer channel 156 of output gear means 152. The very uppermost part of coupling means 200 contains externally threaded cylindrical shaft 210 on which is securely tightened large retaining nut 212 against upper flat surface 149 of output gear means 148. Preferably nut 212 contains internally threaded bore 214 through which screw 216 is advanced until it forcefully engages threaded part 210 thereby preventing nut 212 from inadvertently loosening from shaft 210. Nut 212 therefore retains coupling means 200 in channel 156. Coupling means 200 in turn retains outermost kelly section 162 rotatably mounted inside tubular body 114 and prevents section 162 from falling out housing means 112 under the load produced by kelly means 160, auger 198, dirt retained by the auger, and resistance incurred during removal of the auger from a recently drilled hole. Accordingly coupling means 200 and nut 212 must have sufficient strength to retain kelly section 162 in tubular body 114 for large number of drillings.

Coupling means 200 further comprises axial coupling bore 218 which extends completely through means 200 and serves as a passageway for a cable used to retract telescoped kelly sections as will be subsequently explained in greater detail. It is to be noted that the axis of bore 218 is in axial alignment with torque axis 118 of housing means 112.

Rigidly attached, preferably by welding, to top part of housing means 112 is horizontal platform 220 which serves as a base for mounting the frame of torque generator means 222. Means 222 provides rotary power to the augering apparatus. Generator means 222 is preferably hydraulic powered and is controlled by an operator from a conventional hydraulic control valve housed in operator cab 28. The output power shaft of generator means 222 and input power shaft 153 connected to input gear means 152 of transmission means 140 preferably contain double sprockets 224 and 226, respectively, which are coupled by torque transfer means or double chain 230 as shown best in FIG. 6. Rotary power from torque generator 222 is therefore transferred to transmission means 140, thence to coupling means 200, thence to telescopic kelly means 160 and thence to auger 198.

Figure 6:
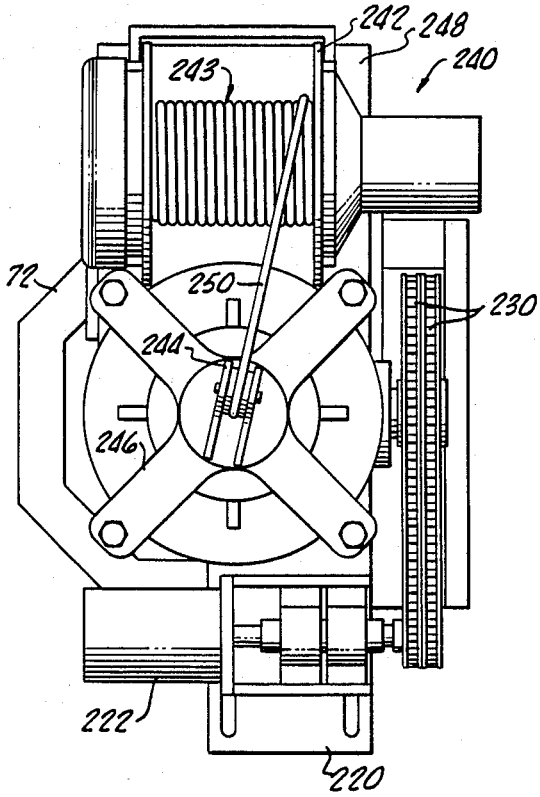
FIG. 6 is a top plan view of the augering apparatus of FIG. 1.

The augering apparatus further comprises winch means indicated generally by numeral 240 which comprises hydraulically powered spool winch 242, swivel pulley assembly means 244 and spacer member or stool bracket 246. Bracket 246 is rigidly attached, preferably by bolting, to the top part of transmission housing 142. Swivelly mounted on bracket 246 is swivel pulley assembly means 244 which is operable for maintaining cable 250 centrally in axial coupling bore 218 for all positions of the cable on spool or drum 243 of winch 242 as shown in FIG. 6. Winch 242 is bolted to horizontal platform 248 which is rigidly connected, preferably by welding, to the upper part of tubular body 114.

Referring now to FIG. 3, one end of flexible tension means or cable 250 is connected to swivel assembly means 252 which is swivelly connected to the top of innermost kelly section 164. The cable is then threaded through bore 218 before coupling means 200 is bolted to outermost kelly section 162. Thence cable 250 is played over the pulley of assembly means 244 and opposite end of the cable secured to drum 243 of winch 242. It can be appreciated that swivel assembly means 252 prevents cable 250 from being twisted as kelly section 164 rotates.

The preferred material of construction for almost all of the components of the drilling apparatus is steel. In particular, the yoke means, cradle means, reaction torque housing means, telescopic kelly means and torque coupling means are almost entirely made of steel. The kelly sections illustrated in the preferred embodiment are as follows:

| Section Element | Outside Square (cm × cm) | Wall Thickness (cm) | Length (cm) |
|---|---|---|---|
| 162 | 25.4 × 25.4 | 1.3 | 218 |
| 176 | 20.3 × 20.3 | 1.3 | 213 |
| 182 | 15.2 × 15.2 | 1.3 | 213 |
| 188 | 10.2 × 10.2 | 1.3 | 213 |
| 164 | 7.6 × 7.6 | solid stock | 213 |

Retainers 172, 174, 178, 180, 184 and 186 are $\frac{3}{8}$ inch (0.95 cm) thick steel plate. The longitudinal length of the retainers is about 15.2 cm. The total telescopic length of the kelly sections for this particular embodiment of this invention is about 7 meters (7 m). In a preferred embodiment the clearances between the kelly sections and the retainer plates on adjacent kelly sections and the length of the retainer plates are such that when the kelly sections are telescoped and rotating there is enough friction between the kelly sections and adjacent retainers that the kelly sections will not retract even when power downcrowded. The dimensions of the above described kelly sections and retainers are an example of kelly means that will not collapse or retract when rotating even with the very forceful downcrowding capability of this invention. However, when rotation is stopped the kelly section can be easily and quickly retracted with winch 242.

Figures 9A, 9B, 9C, 9D, 9E, 9F, 9G, 9H:
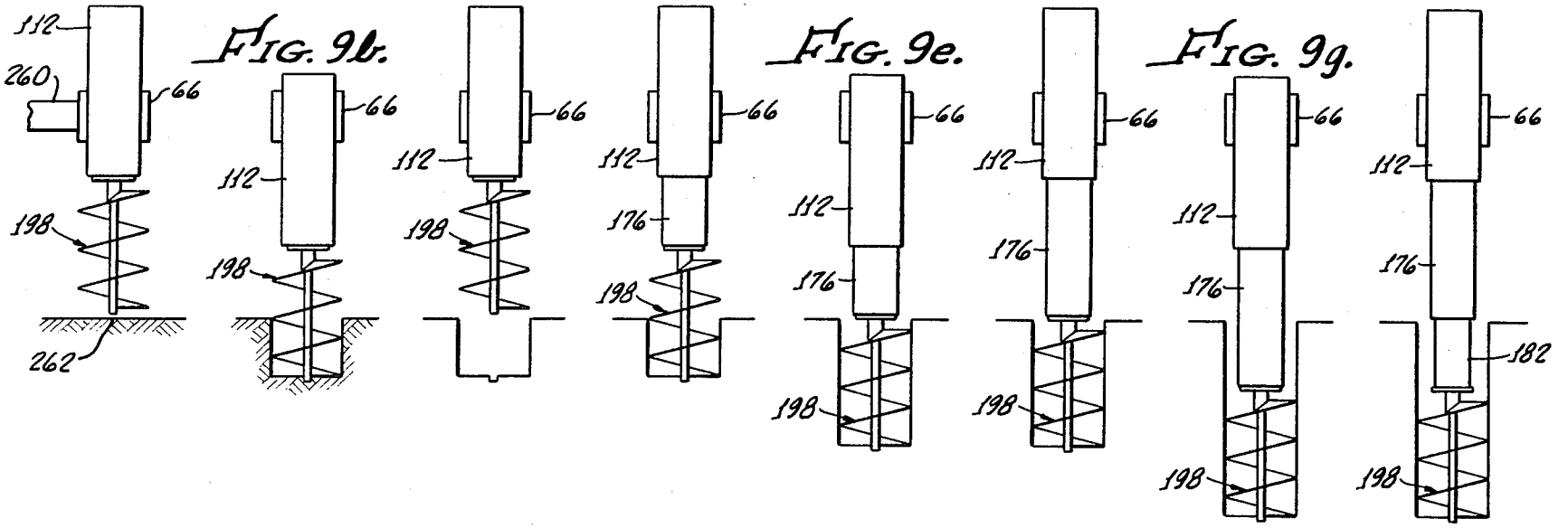
FIGS. 9A through 9T are schematic elevational views of various stages of drilling a hole in the surface of the earth using the augering apparatus of this invention and show how a relatively deep hole can be excavated with the augering apparatus of this invention which has a relatively low overhead requirement.
Figures 9I, 9J, 9K, 9L, 9M, 9N, 9O, 9P:
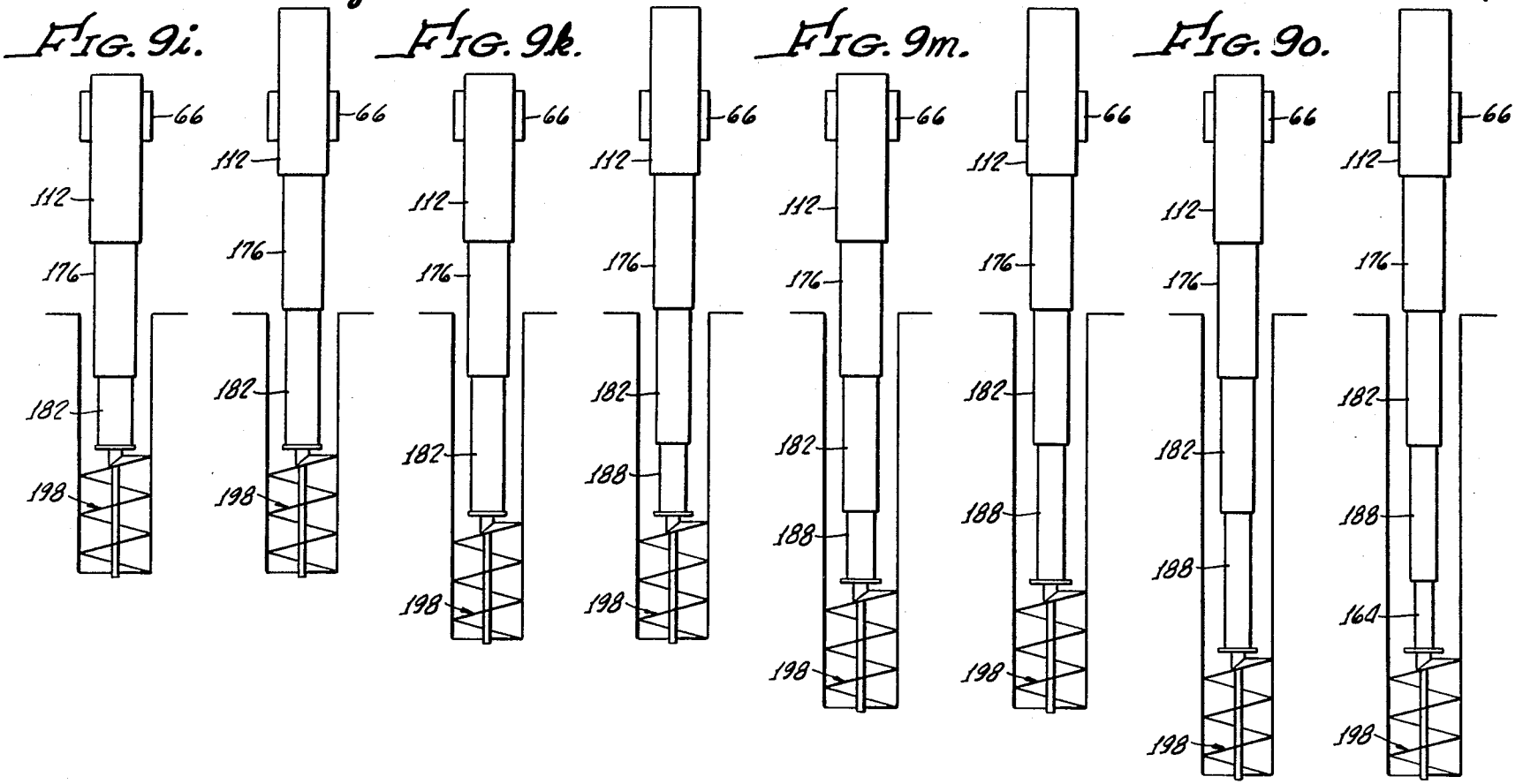
Figures 9Q, 9R, 9S, 9T:
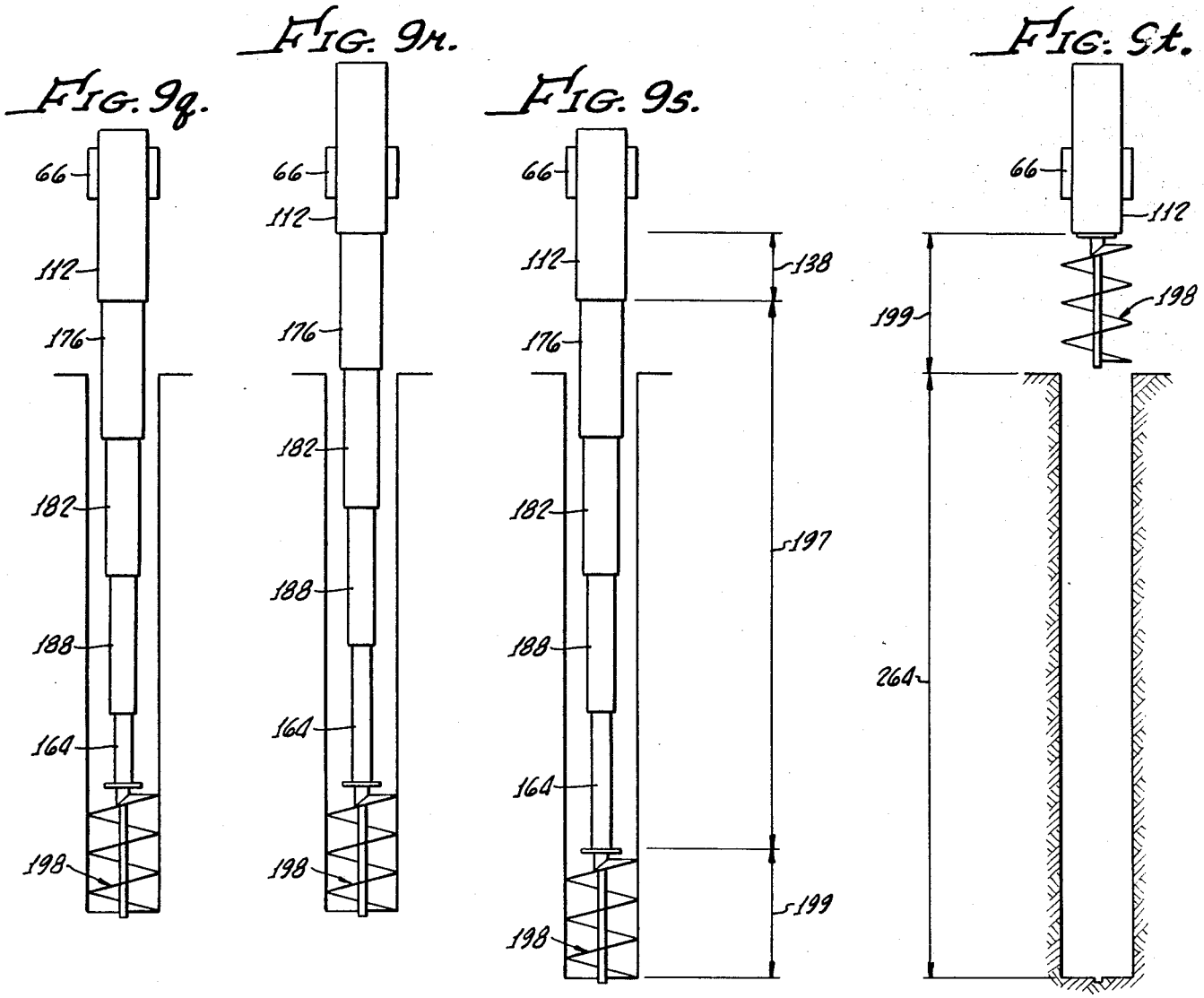

FIGS. 9A through 9T are schematic representations of various stages of excavating or drilling a relative deep hole with the drilling apparatus of this invention. Only cradle means 66, housing means 112, telescopic kelly means 160 and auger 198 are schematically shown in the various drilling stages represented in FIG. 9. However, it is to be understood that a suitable holding means, 260, for positioning the cradle means in a predetermined spatial location and axial drilling orientation relative to a preselected drill site, is securely connected to cradle means 66. In FIG. 9A, cradle means 66 is firmly held by holding means 260 with auger 198 pointing axially vertically downwardly at preselected drill site 262. In FIG. 9A it is to be noted that all kelly sections are completely retracted into reaction torque housing means 112. After positioning the augering apparatus over site 262, auger rotation is started and housing means 112 is downcrowded to the maximum downcrowd stroke length thereby drilling a hole to the depth shown in FIG. 9B. Then auger rotation is stopped and the downcrowd means raised thereby returning housing means 112 to the position shown in FIG. 9C.

At this point holding means 260 can be swung to the side away from site 262 and the dirt spun off the auger. After removing the dirt from the auger, simply referred to hereafter as "dumping", the apparatus is returned to the position shown in FIG. 9C. At this point the kelly sections are allowed to telescope by gravity to the below ground level elevation shown in FIG. 9D.

Once the auger has touched bottom in FIG. 9D, auger rotation is again started and housing 112 is downcrowded again to the maximum stroke length thereby drilling the hole deeper as shown in FIG. 9E. At the end of the stroke, auger rotation is stopped, the downcrowding reversed, and the kelly retracted until the apparatus is again at the elevation and configuration shown in FIG. 9C. The apparatus is then again swung to the side and the dirt dumped.

After dumping, the apparatus is repositioned as in FIG. 9C and the kelly sections are allowed to telescope by gravity to the bottom of the hole as shown in FIG. 9F. Auger rotation is then started and downcrowding commenced thereby drilling the hole to a new depth as shown in FIG. 9G. At the end of the downcrowd stroke, rotation of the auger is stopped, and downcrowding is reversed and the kelly sections retracted until once again the apparatus is the configuration shown in FIG. 9C. The apparatus is then swung to the side and the dirt dumped.

The steps of telescoping, auger rotation, drilling and downcrowding to end of stroke, auger rotation termination, downcrowd reversal and kelly retraction, dumping and repositioning, continue in an identical manner as described above, and as represented schematically in FIGS. 9G, H, I, J, K, L, M, N, O, P, Q, R, S and T until the kelly sections have all been fully telescoped to their maximum telescopic length and downcrowded. The maximum telescopic length is shown as distance 197 in FIG. 9S and the auger length as distance 199. Of course the depth of the hole can be stopped at any desired below ground elevation up to the maximum depth as shown in FIG. T. The maximum depth that a hole can be drilled, distance 264, is seen to equal the maximum downcrowd stroke length or distance 138 and the maximum telescopic length or distance 197 as can be seen from FIGS. 9S and 9T.

Once rotation begins and drilling started there is sufficient friction between the kelly sections that they will not slip or retract and the entire telescoped length, whatever that length may be, acts as a single solid drill rod which is power downcrowded by downcrowding means 122. Once rotation is terminated the telescopic kelly sections can be retracted by winch means 240 and cable 250 until the sections are fully retracted into housing means 112.

When the augering apparatus is mounted on the end of a boom of an excavator, the auger with dirt thereon can be quickly swung over to a dump site and the dirt spun off. The boom can then be quick swung back over the drill site and drilling resumed.

It can be appreciated that the maximum downcrowd stroke length can be designed to any length desired. Greater stroke lengths reduce the number of times the auger must be dumped thereby saving time. However, large stroke lengths increase the overhead height requirements of the augering apparatus.

The length of telescoping for each kelly section can be increased simply by increasing the length of the kelly sections, thereby enabling deeper holes to be drilled. However, longer kelly sections require a longer housing which increases the overhead height requirement of the drilling rig.

The number of kelly sections can be increased if desired, however, increasing the number of kelly sections increases the diameter of housing 114 and weight of the augering apparatus. However, since the overall height of requirement of the auger apparatus is not increased merely by increasing the number of kelly sections, augering apparatuses required to frequently drill at sites having a low overhead, as for example inside side a building having a low ceiling for purposes of installing new foundations for heavy machinery, the use of more kelly sections which are relatively short provides a way of drilling relatively deep holes in a low overhead environment.

Figure 8:
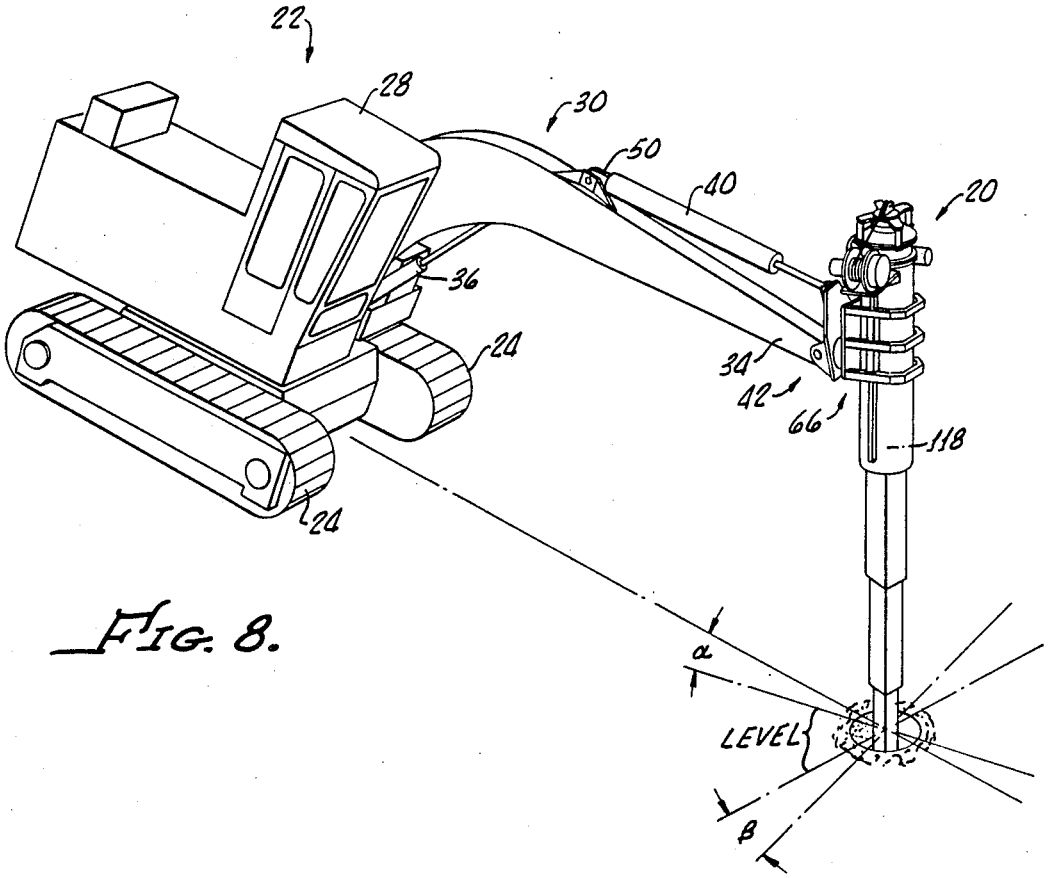
FIG. 8 is a top, front and left side overall perspective view of the augering apparatus of FIG. 1 pivotally connected to an excavator which is on a steep compound slope.

Furthermore the ability of the augering apparatus of this invention to establish a drill angle inclined in any direction either forward or backwards, or right or left, or combinations of both, to the horizontal enable holes to be drilled in any direction. Still further mounting the augering apparatus on the end of a boom of an excavator having a track allows holes to be drilled in steeply and compound inclined terrains as shown in FIG. 8. Mounting the augering apparatus on the end of a boom also allows the drilling rig to reach over a wall or other obstruction, such as a large piece of equipment, and drill a hole without removal of the wall or equipment as shown in FIG. 1. Furthermore because of relative massive amount of hydraulic power available in an excavator and the ability to maintain the cradle at a predetermined spatial location and axial orientation, holes six feet or larger in diameter can be quickly and accurately drilled without axial deviation from the desired direction.

The augering apparatus of this invention can be fitted with an auger as shown in FIG. 1 or with other tools such as drilling buckets, coring barrels, chopping buckets, expansion reamers, boring bars and other hydraulic and pneumatic tools.

Figure 10:
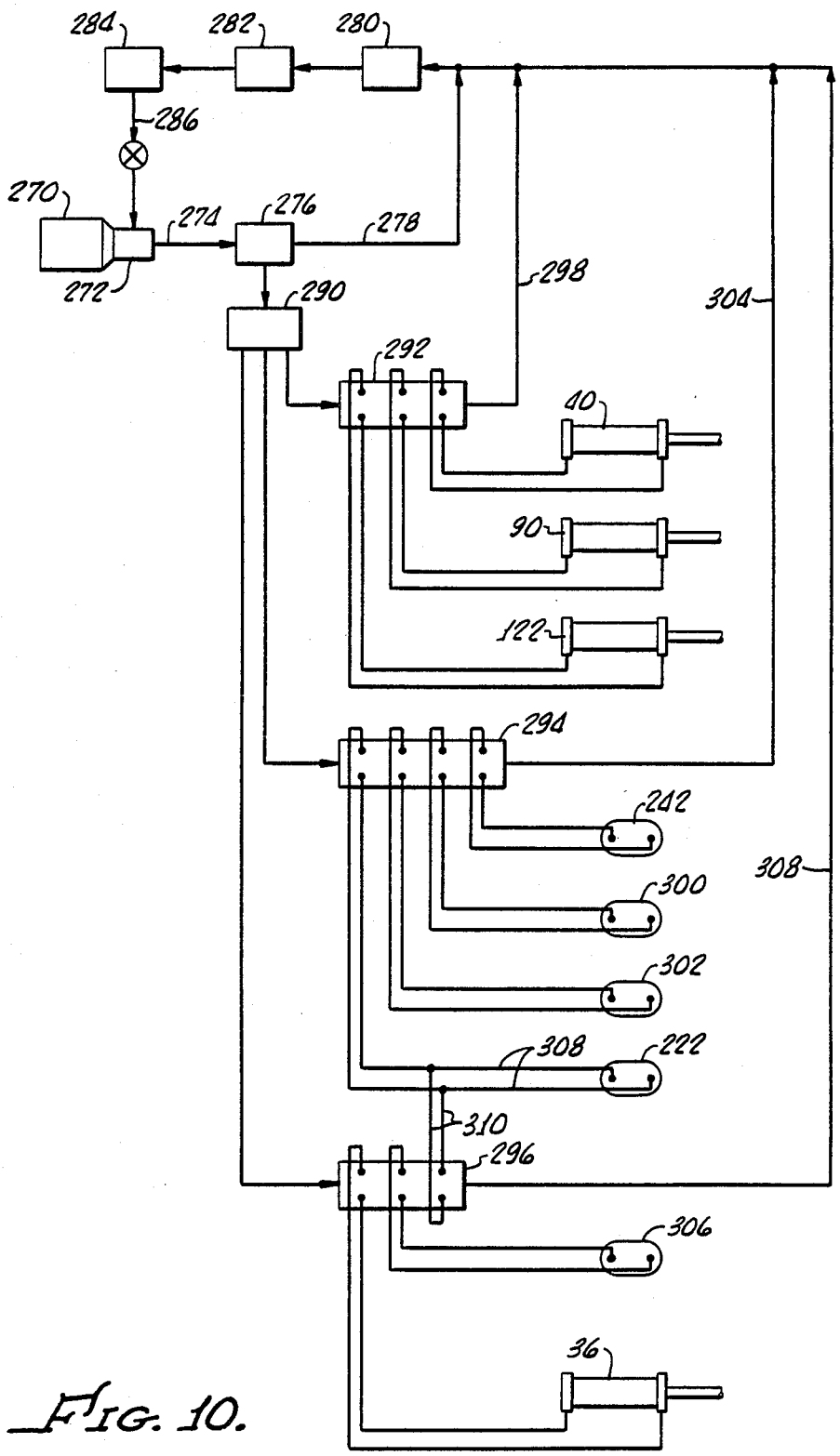
FIG. 10 is a flow diagram of the hydraulic system for the embodiment shown in FIG. 1.

FIG. 10 is a flow block diagram of a hydraulic circuit for a crawler type excavator which has the augering apparatus of this invention mounted on the distal end of the boom as shown in FIG. 1. Gasoline or diesel engine 270 powers hydraulic pump 272 which pumps high pressure hydraulic fluid through line 274 to pressure relief valve 276. When the hydraulic pressure in valve 276 reaches its release set point, valve 276 opens allowing fluid to flow through line 278 into filter 280, thence into cooler 282 and thence into reservoir 284. Fluid is withdrawn from reservoir 284 through line 286 as demanded by pump 272. At pressures below the relief set point of valve 276, fluid flows into selector valve or valves 290 from which it is distributed to various control valves such as valve banks 292, 298 and 296 which typically contain a series of individual spool valves connected to various hydraulic cylinders and motors. Valve bank 292 is shown schematically in FIG. 10 to contain three individual spool valves which are connected by lines to:

(1) hydraulic cylinder 40 which provides means for tilting yoke means 42 fore and aft,
(2) hydraulic cylinder 90 which provides means for tilting cradle means 66 traversely, and
(3) hydraulic cylinder 122 which provides means for downcrowding reaction torque housing means 112.

Each individual spool valve in valve bank 292 allows hydraulic fluid to be pumped into the head end, or the rod end of the hydraulic cylinder, or alternately in a neutral circuit through the individual spool valves whereupon fluid is returned to the reservoir through line 298.

Valve bank 294 is shown schematically in FIG. 10 to contain four individual spool valves which are connected by lines to:

(1) spool winch 242 which provides means for retrieving cable 250.
(2) swing means 300 which provides means for azimuthal positioning of boom means 30,
(3) left track motor means 302 which provides means for rotating the left continuous crawler track of vehicle 22, and
(4) torque generator 222 which provides means for power rotation of kelly sections and auger 198.

Each individual internal spool valve in valve bank 194 allows hydraulic fluid to be pumped in one direction or an opposite direction through rotary elements 242, 300, 302 and 222 thereby causing clockwise or counterclockwise rotation of such rotary elements, or alternatively to be pumped in a neutral circuit through the individual spool valves whereupon fluid is returned to the reservoir through line 304.

Valve bank 296 is shown schematically in FIG. 10 to contain three individual spool valves which are connected by lines to:

(1) torque generator 222,
(2) right track motor means 306 which provides means for rotating the right continuous crawler track of vehicle 22, and
(3) hydraulic cylinder 36 which provides means for elevating or hoisting boom means 30.

Each individual spool valve in valve bank 196 allows hydraulic fluid to be pumped in one direction or an opposite direction through rotary elements 222 and 306 or into the head end or rod end of hydraulic cylinder 36, or alternately to be pumped in a neutral circuit through the individual spool valves whereupon fluid is returned to the reservoir through line 308.

Torque generator 222 is shown schematically to be powered through either lines 308 connected to the first spool valve in valve bank 294 or lines 310 connected to the third spool valve in valve bank 296. Valve bank 296 allows a higher rate of hydraulic fluid to be pumped into the torque generator to drastically increase the rotation of the auger when for example discharging excavated dirt from the auger. Such sudden burst in rotational speed will fling dirt off of the auger in a couple of seconds thereby speeding up the overall all drilling rate for drilling deep holes or many holes.

It is to be understood, however, that the individual spool valves can be grouped in various arrangements in valve banks according to the desires of the user and that the particular arrangement shown in FIG. 10 need not be followed. Such alternative hydraulic circuits are readily known and easily plumbed by one skilled in the art.

EXAMPLE 1

Table 1 is an example of an embodiment of an augering apparatus and drilling rig of this invention. Unless otherwise noted below all components mentioned below are steel. Sizes originally in inches have been converted to centimeters (cm) or meters (m) and no particular significance is to be associated with the decimal point or number of significant figures since they are merely a conversion of inches to centimeters or meters. Furthermore, in some cases, the sizes were nominal sizes in inches and not exact sizes. Component sizes are described with reference to their maximum dimensions and rounded, tapered, chamfered corners are not reported below but are apparent from the figures. The listing below is in chronological order by element number shown in the figures. As used herein "ID" and "OD" mean inside and outside diameter, respectively.

While the preferred embodiments of the present invention have been described, it should be understood that various changes, adaptations and modifications may be made thereto without departing from the spirit of the invention and the scope of the appended claims. It should be understood, therefore, that the invention shown in preferred embodiment and the figures and that variations in such minor details will be apparent to one skilled in the art.

Therefore it is to be understood that the present disclosure and embodiments of this invention described herein are for purposes of illustration and example and that modifications and improvements may be made thereto without departing from the spirit of the invention or from the scope of the claims. The claims, therefore, are to be accorded a range of equivalents commensurate in scope with the advances made over the art.

TABLE 1

| Element No. | Approximate Size |
|---|---|
| 38 | 6.4 cm OD |
| 44 | 109 cm × 55.9 cm × 5.1 cm thickness |
| 46 | 62.2 cm × 17.8 cm × 3.8 cm thickness |
| 54 | 5.1 cm OD |
| 60 | 50.8 cm OD, 45.7 cm ID, 20.3 cm length |
| 70 | 91.4 cm × 61.0 cm × 2.54 cm thickness |
| 72 | 10.2 cm × 10.2 cm square tubing, 0.953 cm wall |
| 78 | 45.7 cm OD, 40.6 cm ID |
| 80 | 40.6 cm OD, 25.4 cm ID |
| 82 | 25.4 cm OD × 25.4 cm length |
| 86 | 35.6 cm OD × 2.54 cm semicircular plates |
| 114 | 40.6 cm OD, 36.8 cm ID |
| 115 | 50.8 cm OD × 40.6 cm ID × 5.08 cm thickness |
| 120 | 5.08 cm × 7.62 cm × 183 cm |
| 166 | 38.1 cm OD, 35.6 cm ID × 38.1 cm length, bronze |
| 168 | 35.6 cm OD, 33.7 cm ID × 38.1 cm length |
| 194 | 22.9 cm OD × 2.54 cm thickness |
| 202 | 22.9 cm × 22.9 cm square outside, 7.62 cm × 7.62 cm square inside, 5.08 cm thickness |
| 208 | 7.62 cm × 7.62 cm square cross section, 55.9 cm length |
| 218 | 2.22 cm ID |

What is claimed is:

1. A downcrowdable telescopic augering apparatus for drilling a hole in the surface of the earth, said augering apparatus intended for rigid attachment to a holding means operable for positioning and maintaining during drilling said augering apparatus at a predetermined spatial location and drilling axial orientation proximate a preselected drill site to be drilled with said augering apparatus, said augering apparatus comprising:

cradle means having an open-ended main frame having a longitudinal central cavity, and receptacle means rigidly attached to said main frame;

reaction torque housing means having an elongated principal body having a cylindrical inside surface which defines a torque axis and a top and a bottom, and guide means rigidly fastened longitudinally on outside of said principal body and extending from proximate said top thereof to proximate said bottom thereof, said longitudinal central cavity of said cradle means for receiving said housing means, said guide means and said receptacle means of said cradle means being operable for permitting slidable displacement of said housing means relative to said receptacle means of said cradle means, said slidable displacement being in, and restricted to, a predetermined straight line direction in axial alignment with said torque axis;

downcrowd means connected at one end thereof to said housing means and connected at an opposite end thereof to said cradle means, such that a predetermined amount of extension of said downcrowd means causes a predetermined amount of straight line displacement of said housing means relative to said receptacle means of said cradle means in a direction in axial alignment with said torque axis of said housing means, said downcrowd means having a predetermined maximum downcrowd stroke length;

torque transmission means having a transmission housing rigidly attached to said top of said principal body of said reaction torque housing means, angle drive means rotatably mounted in said transmission housing and having an output power axis in axial alignment with said torque axis of said reaction torque housing means and an input power axis at an angle to said output power axis, said angle drive means having an axial torque transfer channel extending axially through said angle drive means and in axial alignment with said output power axis;

telescopic kelly means having a plurality of telescoping kelly sections which comprise at least an outermost kelly section and an innermost kelly section, said telescopic kelly means operable for being extended to a predetermined maximum telescopic length, said outermost kelly section being rotatably mounted in said cylindrical inside surface of said reaction torque housing means for rotation about an axis which is in axial alignment with said torque axis of said housing means, except for said innermost kelly section each one of said kelly sections is operable for rotating an inwardly adjacent kelly section, each one of said kelly sections having an axis in axial alignment with said torque axis of said housing means, said innermost kelly section having a bottom part adaptable for coupling to an auger;

torque coupling means for transmitting torque from said angle drive means to said outermost kelly section, said torque coupling means having an upper part which is received in said torque transfer channel of said angle drive means, said upper part and said torque transfer channel being operable for causing said torque coupling means to rotate with the rotation of said angle drive means, said torque coupling means having a lower part rigidly connected to an upper part of said outermost kelly section, said torque coupling means having a coupling bore having an axis in axial alignment with said torque axis of said reaction torque housing means, whereby torque is transmitted from said angle drive means to said torque coupling means and then to said outermost kelly section;

torque generator means for producing rotary power;

torque transfer means for transferring rotary power produced by said torque generator means to said angle drive means along said input power axis;

flexible tension means swivelly connected at one end thereof to said innermost kelly section and connected at an opposite end thereof to winch means, said flexible tension means operable for passing through said coupling bore of said torque coupling means; and winch means for winching up said flexible tension means thereby retracting said plurality of kelly sections into said reaction torque housing means, said augering apparatus being operable for extending a longitudinal distance along said torque axis approximately equal to the sum of said maximum downcrowd stroke length and said maximum telescopic length.

2. The augering apparatus of claim 1, wherein said angle drive means of said torque transmission means is right angle drive means.

3. The augering apparatus of claim 1, wherein each section of said plurality of telescoping kelly sections of said kelly means has a square external periphery.

4. The augering apparatus of claim 1, wherein said innermost kelly section has a square cross section and all other kelly sections have a square tubular cross section.

5. The augering apparatus of claim 4, wherein said axial torque transfer channel of said torque transmission means has a square internal periphery, and wherein said upper part of said torque coupling means which is received in said torque transfer channel has a square external periphery.

6. The augering apparatus of claim 4, wherein said lower part of said torque coupling means has a square periphery which is received internally in, and in abutting relationship with, said upper part of said outermost kelly section.

7. The augering apparatus of claim 1, wherein said downcrowd means comprises a hydraulic cylinder.

8. The augering apparatus of claim 1, wherein said one end of said downcrowd means is connected to said principal body of said housing means and said opposite end of said downcrowd means is connected to said main frame of said cradle means.

9. The augering apparatus of claim 1, wherein said torque generator means has a frame which is rigidly attached to said reaction torque housing means.

10. The apparatus of claim 1, wherein said torque generator means is hydraulic fluid powered.

11. The augering apparatus of claim 1, wherein said plurality of kelly sections telescope by gravity.

12. The augering apparatus of claim 1, wherein said telescopic kelly means when telescoped and rotating is operable while drilling a hole into the surface of the earth for preventing said telescopic kelly means from being retracted into said reaction torque housing means.

13. The augering apparatus of claim 1, wherein said flexible tension means is a cable, wherein said winch means comprises a pulley assembly means swivelly mounted on a spacer member which is rigidly mounted to and extends above said torque transmission means, wherein said winch means further comprises a motorized winch having a spool operable for spooling up said cable, wherein said cable rides on said pulley means, and wherein said pulley means is operable for swiveling relative to said spacer member so that said cable rides centrally in said coupling bore of said coupling means for all positions of said cable on said spool.

14. A downcrowdable telescopic augering apparatus for drilling a hole in the surface of the earth, said augering apparatus intended for rigid attachment to a holding means operable for positioning and maintaining during drilling said augering apparatus at a predetermined spatial location and drilling axial orientation proximate a preselected drill site to be drilled with said augering apparatus, said augering apparatus comprising:

cradle means having an open-ended main frame having a longitudinal central cavity, and receptacle means rigidly attached to said main frame;

reaction torque housing means having an elongated principal body having a cylindrical inside surface which defines a torque axis and a top and a bottom, guide means rigidly fastened longitudinally on outside of said principal body and extending from proximate said top thereof to proximate said bottom thereof, said longitudinal central cavity of said cradle means for receiving said housing means, said guide means and said receptacle means of said cradle means being operable for permitting slidable displacement of said housing means relative to said receptacle means of said cradle means, said slidable displacement being in, and restricted to, a predetermined straight line direction in axial alignment with said torque axis;

downcrowd hydraulic cylinder means connected at one end thereof to said principal body of said housing means and connected at an opposite end thereof to said main frame of said cradle means, such that a predetermined amount of extension of said downcrowd hydraulic cylinder means causes a predetermined amount of straight line displacement of said housing means relative to said receptacle means of said cradle means in a direction in axial alignment with said torque axis of said housing means, said downcrowd hydraulic cylinder means having a predetermined maximum downcrowd stroke length;

torque transmission means having a transmission housing rigidly attached to said top of said principal body of said reaction torque housing means, angle drive means rotatably mounted in said transmission housing and having output gear means having an output power axis in axial alignment with said torque axis of said reaction torque housing means and input gear means having an input power axis at an angle to said output power axis, said input gear means being operable for driving said output gear means, said output gear means having an axial torque transfer channel extending axially through said output gear means and in axial alignment with said output power axis;

telescopic kelly means having a plurality of telescoping kelly sections which comprise at least an outermost kelly section and an innermost kelly section, said telescopic kelly means operable for being extended to a predetermined maximum telescopic length, said outermost kelly section having rigidly attached to the outside thereof a kelly bearing which is rotatably mounted in said cylindrical inside surface of said reaction torque housing means for rotation about an axis which is in axial alignment with said torque axis of said housing means, except for said innermost kelly section each one of said kelly sections is operable for rotating an inwardly adjacent kelly section, each one of said kelly sections having an axis in axial alignment with said torque axis of said housing means, said innermost kelly section having a bottom part adaptable for coupling to an auger;

torque coupling means for transmitting torque from said angle drive means to said outermost kelly section and for maintaining said outermost kelly section rotatably mounted in said reaction torque housing means, said torque coupling means having an upper part which is received in said torque transfer channel of said output gear means, said upper part and said torque transfer channel being operable for causing said torque coupling means to rotate with the rotation of said output gear means, said torque coupling means having a lower part rigidly connected to an upper part of said outermost kelly section, said torque coupling means having a coupling bore having an axis in axial alignment with said torque axis of said reaction torque housing means, whereby torque is transmitted from said output gear means to said torque coupling means and then to said outermost kelly section;

torque generator means for producing rotary power;

torque transfer means for transferring rotary power produced by said torque generator means to said input gear means of said torque transmission means whereby said torque generator means drives said torque transfer means which drives said input gear means of said torque transmission means;

flexible tension means swivelly connected at one end thereof to said innermost kelly section and connected at an opposite end thereof to winch means, said flexible tension means operable for passing through said coupling bore of said torque coupling means; and winch means for winching up said flexible tension means thereby retracting said plurality of kelly sections into said reaction torque housing means, said winch means being rigidly attached to said reaction torque housing means, said augering apparatus being operable for extending a longitudinal distance along said torque axis approximately equal to the sum of said maximum downcrowd stroke length and said maximum telescopic length, whereupon coupling an auger to said bottom part of said innermost kelly section and attaching said augering apparatus to such a holding means, a hole can be drilled at such preselected drill site to a depth approximately equal to said longitudinal distance.

15. A downcrowdable telescopic augering apparatus for drilling a hole in the surface of the earth, said augering apparatus comprising:

cradle means having an open-ended main frame having a longitudinal central cavity, and receptacle means rigidly attached to said main frame;

reaction torque housing means having an elongated principal body having a cylindrical inside surface which defines a torque axis and a top and a bottom, guide means rigidly fastened longitudinally on outside of said principal body and extending from proximate said top thereof to proximate said bottom thereof, said longitudinal central cavity of said cradle means for receiving said housing means, said guide means and said receptacle means of said cradle means being operable for permitting slidable displacement of said housing means relative to said receptacle means of said cradle means, said slidable displacement being in, and restricted to, a predetermined straight line direction in axial alignment with said torque axis;

downcrowd hydraulic cylinder means connected at one end thereof to said principal body of said housing means and connected at an opposite end thereof to said main frame of said cradle means, such that a predetermined amount of extension of said downcrowd hydraulic cylinder means causes a predetermined amount of straight line displacement of said housing means relative to said receptacle means of said cradle means in a direction in axial alignment with said torque axis of said housing means, said downcrowd hydraulic cylinder means having a predetermined maximum downcrowd stroke length;

torque transmission means having a transmission housing rigidly attached to said top of said principal body of said reaction torque housing means, angle drive means rotatably mounted in said transmission housing and having output gear means having an output power axis in axial alignment with said torque axis of said reaction torque housing means and input gear means having an input power axis at an angle to said output power axis, said input gear means being operable for driving said output gear means, said output gear means having an axial torque transfer channel extending axially through said output gear means and in axial alignment with said output power axis;

telescopic kelly means having a plurality of telescoping kelly sections which comprise at least an outermost kelly section and an innermost kelly section, said telescopic kelly means operable for being extended to a predetermined maximum telescopic length, said outermost kelly section having rigidly attached to the outside thereof a kelly bearing which is rotatably mounted in said cylindrical inside surface of said reaction torque housing means for rotation about an axis which is in axial alignment with said torque axis of said housing means, except for said innermost kelly section each one of said kelly sections is operable for rotating an inwardly adjacent kelly section, each one of said kelly sections having an axis in axial alignment with said torque axis of said housing means, said innermost kelly section having a bottom part adaptable for coupling to an auger;

torque coupling means for transmitting torque from said angle drive means to said outermost kelly section and for maintaining said outermost kelly section rotatably mounted in said reaction torque housing means, said torque coupling means having an upper part which is received in said torque transfer channel of said output gear means, said upper part and said torque transfer channel being operable for causing said torque coupling means to rotate with the rotation of said output gear means, said torque coupling means having a lower part rigidly connected to an upper part of said outermost kelly section, said torque coupling means having a coupling bore having an axis in axial alignment with said torque axis of said reaction torque housing means, whereby torque is transmitted from said output gear means to said torque coupling means and then to said outermost kelly section;

torque generator means for producing rotary power;

torque transfer means for transferring rotary power produced by said torque generator means to said input gear means of said torque transmission means whereby said torque generator means drives said torque transfer means which drives said input gear means of said torque transmission means;

flexible tension means swivelly connected at one end thereof to said innermost kelly section and connected at an opposite end thereof to winch means, said flexible tension means operable for passing through said coupling bore of said torque coupling means;

winch means for winching up said flexible tension means thereby retracting said plurality of kelly sections into said reaction torque housing means, said winch means being rigidly attached to said reaction torque housing means; and holding means for rigidly positioning and maintaining during drilling said cradle means at a predetermined spatial location and predetermined orientation of said torque axis of said housing means, said augering apparatus being operable for extending a longitudinal distance along said torque axis approximately equal to the sum of said maximum downcrowd stroke length and said maximum telescopic length, whereupon coupling an auger to said bottom part of said innermost kelly section and positioning said augering apparatus so that said torque axis is aligned with the axis of a hole to be drilled, such a hole can be drilled at a preselected drill site to a depth approximately equal to said longitudinal distance.

16. A downcrowdable telescopic augering apparatus for drilling a hole in the surface of the earth, said augering apparatus adaptable for attachment to the distal end of a boom of an earth excavating machine, said machine being operable for azimuthal and elevational positioning of said distal end of said boom, said distal end having a main pin traverse to said boom for pivotal attachment of an earth excavating device, said machine having longitudinal tilt hydraulic cylinder means for pivoting of such device in the plane of the boom about said main pin of said boom, said augering apparatus comprising:

yoke means having a main body, longitudinal bearing means rigidly attached to said main body and pivotally connected to said main pin of said boom, tilt bearing means rigidly attached to said main body and pivotally connected to said longitudinal tilt hydraulic cylinder means such that a predetermined amount of extension of said longitudinal tilt hydraulic cylinder means causes a predetermined amount of pivoting of said yoke means in the plane of said boom about said main pin of said boom, and traverse bearing means rigidly attached to said main body;

cradle means having an open-ended main frame having a longitudinal central cavity, traverse trunnion means rigidly attached to said mainframe and pivotally connected to said traverse bearing means of said yoke means, said traverse trunnion means and said traverse bearing means being operable for permitting said cradle means to be pivoted in a plane perpendicular to said plane of said boom, and receptacle means rigidly attached to said main frame;

traverse tilt hydraulic cylinder means for controlled pivoting of said cradle means relative to said yoke means in a plane perpendicular to said plane of said boom;

reaction torque housing means having an elongated principal body having a cylindrical inside surface which defines a torque axis and a top and a bottom, guide means rigidly fastened longitudinally on outside of said principal body and extending from proximate said top thereof to proximate said bottom thereof, said longitudinal central cavity of said cradle means for receiving said housing means, said guide means and said receptacle means of said cradle means being operable for permitting slidable displacement of said housing means relative to said receptacle means of said cradle means, said slidable displacement being in, and restricted to, a predetermined straight line direction in axial alignment with said torque axis;

downcrowd hydraulic cylinder means connected at one end thereof to said principal body of said housing means and connected at an opposite end thereof to said main frame of said cradle means, such that a predetermined amount of extension of said downcrowd hydraulic cylinder means causes a predetermined amount of straight line displacement of said housing means relative to said receptacle means of said cradle means in a direction in axial alignment with said torque axis of said housing means, said downcrowd hydraulic cylinder means having a predetermined maximum downcrowd stroke length;

torque transmission means having a transmission housing rigidly attached to said top of said principal body of said reaction torque housing means, angle drive means rotatably mounted in said transmission housing and having output gear means having an output power axis in axial alignment with said torque axis of said reaction torque housing means and input gear means having an input power axis at an angle to said output power axis, said input gear means being operable for driving said output gear means, said output gear means having an axial torque transfer channel extending axially through said output gear means and in axial alignment with said output power axis;

telescopic kelly means having a plurality of telescoping kelly sections which comprise at least an outermost kelly section and an innermost kelly section, said telescopic kelly means operable for being extended to a predetermined maximum telescopic length, said outermost kelly section having rigidly attached to the outside thereof a kelly bearing which is rotatably mounted in said cylindrical inside surface of said reaction torque housing means for rotation about an axis which is in axial alignment with said torque axis of said housing means, except for said innermost kelly section each one of said kelly sections is operable for rotating an inwardly adjacent kelly section, each one of said kelly sections having an axis in axial alignment with said torque axis of said housing means, said innermost kelly section having a bottom part adaptable for coupling to an auger;

torque coupling means for transmitting torque from said angle drive means to said outermost kelly section and for maintaining said outermost kelly section rotatably mounted in said reaction torque housing means, said torque coupling means having an upper part which is received in said torque transfer channel of said output gear means, said upper part and said torque transfer channel being operable for causing said torque coupling means to rotate with the rotation of said output gear means, said torque coupling means having a lower part rigidly connected to an upper part of said outermost kelly section, said torque coupling means having a coupling bore having an axis in axial alignment with said torque axis of said reaction torque housing means, whereby torque is transmitted from said output gear means to said torque coupling means and then to said outermost kelly section;

torque generator means for producing rotary power;

torque transfer means for transferring rotary power produced by said torque generator means to said input gear means of said torque transmission means whereby said torque generator means drives said torque transfer means which drives said input gear means of said torque transmission means;

flexible tension means swivelly connected at one end thereof to said innermost kelly section and connected at an opposite end thereof to winch means, said flexible tension means operable for passing through said coupling bore of said torque coupling means; and winch means for winching up said flexible tension means thereby retracting said plurality of kelly sections into said reaction torque housing means, said winch means being rigidly attached to said reaction torque housing means, said augering apparatus being operable for extending a longitudinal distance along said torque axis approximately equal to the sum of said maximum downcrowd stroke length and said maximum telescopic length, whereupon coupling an auger to said bottom part of said innermost kelly section and positioning said augering apparatus so that said torque axis is aligned with the axis of a hole to be drilled, such a hole can be drilled at a preselected drill site to a depth approximately equal to said longitudinal distance.

17. The augering apparatus of claim 16, wherein said traverse tilt hydraulic cylinder means is pivotally connected at one end thereof to said cradle means and pivotally connected at an opposite end thereof to said yoke means, such that a predetermined amount of extension of said traverse tilt hydraulic cylinder means causes a predetermined amount of pivoting of said cradle means relative to said yoke means.

18. The augering apparatus of claim 16, wherein said traverse tilt hydraulic cylinder means is pivotally connected at one end thereof to said main frame of said cradle means and pivotally connected at an opposite end thereof to said main body of said yoke means, such that a predetermined amount of extension of said traverse tilt hydraulic cylinder means causes a predetermined amount of pivoting of said cradle means relative to said yoke means.

19. The augering apparatus of claim 4, wherein said traverse tilt hydraulic cylinder means and said downcrowd hydraulic cylinder means each comprise a double acting hydraulic cylinder and three-way hydraulic control valve.

20. A downcrowdable telescopic augering apparatus for drilling a hole in the surface of the earth, said augering apparatus adaptable for attachment to the distal end of a boom of an earth excavating machine, said machine being operable for azimuthal and elevational positioning of said distal end of said boom, said distal end having a main pin traverse to said boom for pivotal attachment of an earth excavating device, said machine having longitudinal tilt hydraulic cylinder means pivotally connected at one end thereof to said boom means at a point thereon spaced away from said distal end, and pivotally connected at an opposite end of said longitudinal tilt hydraulic cylinder means to such device such that a predetermined amount of extension of said longitudinal tilt hydraulic cylinders means causes a predetermined amount of pivoting of such device in the plane of the boom about said main pin of said boom, said augering apparatus comprising:

yoke means having a main body, longitudinal bearing means rigidly attached to said main body and pivotally connected to said main pin of said boom, tilt bearing means rigidly attached to said main body and pivotally connected to said opposite end of said longitudinal tilt hydraulic cylinder means such that a predetermined amount of extension of said longitudinal tilt hydraulic cylinder means causes a predetermined amount of pivoting of said yoke means in the plane of said boom about said main pin of said boom, and traverse bearing means rigidly attached to said main body;

cradle means having an open-ended main frame having a longitudinal central cavity, traverse trunnion means rigidly attached to said mainframe and pivotally connected to said traverse bearing means of said yoke means, said traverse trunnion means and said traverse bearing means being operable for permitting said cradle means to be pivoted in a plane perpendicular to said plane of said boom, and receptacle means rigidly attached to said main frame;

traverse tilt hydraulic cylinder means for controlled pivoting of said cradle means relative to said yoke means in a plane perpendicular to said plane of said boom, said traverse tilt hydraulic cylinder means being pivotally connected at one end thereof to said main frame of said cradle means and pivotally connected at an opposite end of said traverse tilt hydraulic cylinder means to said main body of said yoke means, such that a predetermined amount of extension of said traverse tilt hydraulic cylinder means causes a predetermined amount of pivoting of said cradle means relative to said yoke means;

reaction torque housing means having an elongated principal body having a cylindrical inside surface which defines a torque axis and a top and a bottom, guide means rigidly fastened longitudinally on outside of said principal body and extending from proximate said top thereof to proximate said bottom thereof, said longitudinal central cavity of said cradle means for receiving said housing means, said guide means and said receptacle means of said cradle means being operable for permitting slidable displacement of said housing means relative to said receptacle means of said cradle means, said slidable displacement being in, and restricted to, a predetermined straight line direction in axial alignment with said torque axis;

downcrowd hydraulic cylinder means connected at one end thereof to said principal body of said housing means and connected at an opposite end thereof to said main frame of said cradle means, such that a predetermined amount of extension of said downcrowd hydraulic cylinder means causes a predetermined amount of straight line displacement of said housing means relative to said receptacle means of said cradle means in a direction in axial alignment with said torque axis of said housing means, said downcrowd hydraulic cylinder means having a predetermined maximum downcrowd stroke length;

torque transmission means having a transmission housing rigidly attached to said top of said principal body of said reaction torque housing means, right angle drive means rotatably mounted in said transmission housing and having output gear means having an output power axis in axial alignment with said torque axis of said reaction torque housing means and input gear means having an input power axis at a right angle to said output power axis, said input gear means being operable for driving said output gear means, said output gear means having an axial torque transfer channel extending axially through said output gear means and in axial alignment with said output power axis;

telescopic kelly means having a plurality of telescoping kelly sections which comprise at least an outermost kelly section and an innermost kelly section, said telescopic kelly means operable for being extended to a predetermined maximum telescopic length, said outermost kelly section having rigidly attached to the outside thereof a kelly bearing which is rotatably mounted in said cylindrical inside surface of said reaction torque housing means for rotation about an axis which is in axial alignment with said torque axis of said housing means, except for said innermost kelly section each one of said kelly sections is operable for rotating an inwardly adjacent kelly section, each one of said kelly sections having an axis in axial alignment with said torque axis of said housing means, said telescopic kelly means being operable when telescoped and rotating and when drilling a hole into the surface of the earth for preventing said telescopic kelly means from being retracted into said reaction torque housing means, said innermost kelly section having a bottom part adaptable for coupling to an auger;

torque coupling means for transmitting torque from said angle drive means to said outermost kelly section and for maintaining said outermost kelly section rotatably mounted in said reaction torque housing means, said torque coupling means having an upper part which is received in said torque transfer channel of said output gear means, said upper part and said torque transfer channel being operable for causing said torque coupling means to rotate with the rotation of said output gear means, said torque coupling means having a lower part rigidly connected to an upper part of said outermost kelly section, said torque coupling means having a coupling bore having an axis in axial alignment with said torque axis of said reaction torque housing means, whereby torque is transmitted from said output gear means to said torque coupling means and then to said outermost kelly section;

hydraulic powered torque generator means for producing rotary power, said generator means having a frame which is rigidly attached to a structural member which is rigidly attached to said reaction torque housing means;

torque transfer means for transferring rotary power produced by said torque generator means to said input gear means of said torque transmission means whereby said torque generator means drives said torque transfer means which drives said input gear means of said torque transmission means;

flexible tension means swivelly connected at one end thereof to said innermost kelly section and connected at an opposite end thereof to winch means, said flexible tension means operable for passing through said coupling bore of said torque coupling means; and winch means for winching up said flexible tension means thereby retracting said plurality of kelly sections into said reaction torque housing means, said winch means being rigidly attached to said reaction torque housing means, said augering apparatus being operable for extending a longitudinal distance along said torque axis approximately equal to the sum of said maximum downcrowd stroke length and said maximum telescopic length, whereupon coupling an auger to said bottom part of said innermost kelly section and positioning said augering apparatus so that said torque axis is aligned with the axis of a hole to be drilled, such a hole can be drilled at a preselected drill site to a depth approximately equal to said longitudinal distance.

21. A downcrowdable telescopic augering apparatus for drilling a hole in the surface of the earth, said augering apparatus intended for rigid attachment to a holding means operable for positioning and maintaining during drilling said augering apparatus at a predetermined spatial location and drilling axial orientation proximate a preselected drill site to be drilled with said augering apparatus, said augering apparatus comprising:

cradle means having an open-ended main frame having a longitudinal central cavity, and receptacle means rigidly attached to said main frame;

reaction torque housing means having a principal body having a cylindrical inside surface which defines a torque axis, and guide means rigidly fastened longitudinally on outside of said principal body, said longitudinal central cavity of said cradle means for receiving said housing means, said guide means and said receptacle means of said cradle means being operable for permitting slidable displacement of said housing means relative to said receptacle means, said slidable displacement being in, and restricted to, a predetermined straight line direction in axial alignment with said torque axis;

downcrowd means connected to said housing means and said cradle means, such that a predetermined amount of extension of said downcrowd means causes a predetermined amount of straight line displacement of said housing means relative to said cradle means in a direction in axial alignment with said torque axis, said downcrowd means having a predetermined maximum downcrowd stroke length;

torque transmission means rigidly attached to the top of said principal body of said reaction torque housing means, said torque transmission means for receiving torque along an input power axis at an angle to said torque axis and transmitting torque through an axial torque transfer channel extending axially through said torque transmission means in axial alignment with said torque axis;

telescopic kelly means having a plurality of telescoping kelly sections which comprise at least an outermost kelly section and an innermost kelly section, said telescopic kelly means operable for being extended to a predetermined maximum telescopic length, said outermost kelly section being rotatably mounted in said reaction torque housing means for rotation about said torque axis of said housing means, except for said innermost kelly section each one of said kelly sections is operable for rotating an inwardly adjacent kelly section, each one of said kelly sections having an axis in axial alignment with said torque axis, said innermost kelly section having a bottom part adaptable for coupling to an auger;

torque coupling means for transmitting torque from said torque transmission means to said outermost kelly section, said torque coupling means having an upper part which is received in said torque transfer channel of said torque transmission means and a lower part rigidly connected to an upper part of said outermost kelly section, said torque coupling means having a coupling bore having an axis in axial alignment with said torque axis of said reaction torque housing means;

torque generator means for producing rotary power;

torque transfer means for transferring rotary power produced by said torque generator means to said torque transmission means;

flexible tension means swivelly connected at one end thereof to said innermost kelly section and connected at an opposite end thereof to winch means, said flexible tension means operable for freely passing through said coupling bore of said torque coupling means; and winch means for winching up said flexible tension means thereby retracting said plurality of kelly sections into said reaction torque housing means, said augering apparatus being operable for extending a longitudinal distance along said torque axis approximately equal to the sum of said maximum downcrowd stroke length and said maximum telescopic length.

22. A downcrowdable telescopic augering apparatus for drilling a hole in the surface of the earth, said augering apparatus intended for rigid attachment to a holding means operable for positioning and maintaining during drilling said augering apparatus at a predetermined spatial location and drilling axial orientation proximate a preselected drill site to be drilled with said augering apparatus, said augering apparatus comprising:

cradle means having an open-ended main frame having a longitudinal central cavity, and receptacle means rigidly attached to said main frame;

reaction torque housing means having a principal body having a cylindrical inside surface which defines a torque axis, and guide means rigidly fastened longitudinally on outside of said principal body, said longitudinal central cavity of said cradle means for receiving said housing means for receiving said housing means, said guide means and said receptacle means of said cradle means being operable for permitting slidable displacement of said housing means relative to said receptacle means, said slidable displacement being in, and restricted to, a predetermined straight line direction in axial alignment with said torque axis;

downcrowd means connected to said housing means and said cradle means, such that a predetermined amount of extension of said downcrowd means causes a predetermined amount of straight line displacement of said housing means relative to said cradle means in a direction in axial alignment with said torque axis, said downcrowd means having a predetermined maximum downcrowd stroke length;

torque transmission means rigidly attached to the top of said principal body of said reaction torque housing means, said torque transmission means adaptable for receiving torque from a source of rotary power along an input power axis at an angle to said torque axis and transmitting torque through an axial torque transfer channel extending axially through said torque transmission means in axial alignment with said torque axis;

telescopic kelly means having a plurality of telescoping kelly sections which comprise at least an outermost kelly section and an innermost kelly section, said telescopic kelly means operable for being extended to a predetermined maximum telescopic length, said outermost kelly section being rotatably mounted in said reaction torque housing means for rotation about said torque axis of said housing means, except for said innermost kelly section each one of said kelly sections is operable for rotating an inwardly adjacent kelly section, each one of said kelly sections having an axis in axial alignment with said torque axis said innermost kelly section having a bottom part adaptable for coupling to an auger; and torque coupling means for transmitting torque from said torque transmission means to said outermost kelly section, said torque coupling means having an upper part which is received in said torque transfer channel of said torque transmission means and a lower part rigidly connected to an upper part of said outermost kelly section, said torque coupling means having a coupling bore having an axis in axial alignment with said torque axis of said reaction torque housing means, said innermost kelly means intended for swivel connection at the top end thereof to a flexible tension means that is operable for passing freely through said coupling bore of said torque coupling means, such flexible tension means intended for connection to means for winching up such flexible tension means so as to retract said plurality of kelly sections into said reaction torque housing means, said augering apparatus being operable for extending a longitudinal distance along said torque axis approximately equal to the sum of said maximum downcrowd stroke length and said maximum telescopic length.

23. A downcrowdable telescopic augering apparatus for drilling a hole in the surface of the earth comprising:

cradle means having a longitudinal central cavity and receptacle means;

reaction torque housing means having a principal body having a cylindrical inside surface which defines a torque axis, and guide means rigidly fastened longitudinally on-outside of said principal body, said longitudinal central cavity of said cradle means for receiving said housing means for receiving said housing means, said guide means and said receptacle means of said cradle means being operable for permitting slidable displacement of said housing means relative to said receptacle means, said slidable displacement being in, and restricted to, a predetermined straight line direction in axial alignment with said torque axis;

downcrowd means connected to said housing means and said cradle means, such that a predetermined amount of extension of said downcrowd means causes a predetermined amount of straight line displacement of said housing means relative to said cradle means in a direction in axial alignment with said torque axis, said downcrowd means having a predetermined maximum downcrowd stroke length;

torque transmission means rigidly attached to the top of said principal body of said reaction torque housing means, said torque transmission means adaptable for receiving torque from a source of rotary power along an input power axis at an angle to said torque axis and transmitting torque through an axial torque transfer channel extending axially through said torque transmission means in axial alignment with said torque axis;

telescopic kelly means having a plurality of telescoping kelly sections which comprise at least an outermost kelly section and an innermost kelly section, said telescopic kelly means operable for being extended to a predetermined maximum telescopic length, said outermost kelly section being rotatably mounted in said reaction torque housing means for rotation about said torque axis of said housing means, except for said innermost kelly section each one of said kelly sections is operable for rotating an inwardly adjacent kelly section, each one of said kelly sections having an axis in axial alignment with said torque axis said innermost kelly section having a bottom part adaptable for coupling to an auger; and torque coupling means for transmitting torque from said torque transmission means to said outermost kelly section, said torque coupling means having an upper part which is received in said torque transfer channel of said torque transmission means and a lower part rigidly connected to an upper part of said outermost kelly section, said torque coupling means having a coupling bore having an axis in axial alignment with said torque axis of said reaction torque housing means, said coupling bore intended as a longitudinal opening for a cable swivelly connected to said innermost kelly section for retracting said plurality of kelly sections into said reaction torque housing means, said augering apparatus being operable for extending a longitudinal distance along said torque axis approximately equal to the sum of said maximum downcrowd stroke length and said maximum telescopic length.

24. A downcrowdable telescopic augering apparatus for drilling a hole in the surface of the earth comprising:

cradle means having a longitudinal central cavity and receptacle means;

reaction torque housing means having a principal body having a cylindrical inside surface which defines a torque axis, and guide means rigidly fastened longitudinally on outside of said principal body, said longitudinal central cavity of said cradle means for receiving said housing means, said guide means and said receptacle means of said cradle means being operable for permitting slidable displacement of said housing means relative to said receptacle means in, and restricted to, a predetermined straight line direction in axial alignment with said torque axis;

downcrowd means for downcrowding said housing means relative to said cradle means in said predetermined straight line direction a predetermined maximum downcrowd length;

torque transmission means rigidly attached to the top of said principle body of said reaction torque housing means, said torque transmission means adaptable for receiving torque from a source of rotary power along an input power axis at an angle to said torque axis and transmitting torque through an axial torque transfer channel extending through said torque transmission means in axial alignment with said torque axis;

telescopic kelly means having a plurality of telescoping kelly sections which comprise at least an outermost kelly section and an innermost kelly section, said telescopic kelly means operable for being extended to a predeter, mined maximum telescopic length, said outermost kelly section being rotatably mounted in said reaction torque housing means for rotation about said torque axis of said housing means, except for said innermost kelly section each one of said kelly sections is operable for rotating an inwardly adjacent kelly section, each one of said kelly sections having an axis in axial alignment with said torque axis, said innermost kelly section having a bottom part adaptable for coupling to an auger; and torque coupling means for transmitting torque from said torque transmission means to said outermost kelly section, said torque coupling means having an upper part which is received in said torque transfer channel of said torque transmission means and a lower part rigidly connected to an upper part of said outermost kelly section, said torque coupling means having a coupling passageway having an axis in axial alignment with said torque axis, said coupling passageway forming a longitudinal opening through said transmission means for means intended to be swivelly connected to said innermost kelly section for retracting said plurality of kelly sections into said reaction torque housing means, said augering apparatus being operable for extending a longitudinal distance along said torque axis approximately equal to the sum of said maximum downcrowd length and said maximum telescopic length.

25. A downcrowdable telescopic augering apparatus for drilling a hole in the surface of the earth comprising:

cradle means having a longitudinal central cavity and receptacle means;

reaction torque housing means having a principal body having a cylindrical inside surface which defines a torque axis, and guide means rigidly fastened longitudinally on outside of said principal body, said longitudinal central cavity of said cradle means for receiving said housing means, said guide means and said receptacle means of said cradle means being operable for permitting slidable displacement of said housing means relative to said receptacle means in, and restricted to, a predetermined straight line direction in axial alignment with said torque axis;

downcrowd means for downcrowding said housing means relative to said cradle means in said predetermined straight line direction;

torque transmission means rigidly attached to said principle body of said reaction torque housing means, said torque transmission means adaptable for receiving torque from a source of rotary power along an input power axis at an angle to said torque axis and transmitting torque through an axial torque transfer channel extending through said torque transmission means in axial alignment with said torque axis;

telescopic kelly means having a plurality of telescoping kelly sections which comprise at least an outermost kelly section and an innermost kelly section, said outermost kelly section being rotatably mounted in said reaction torque housing means for rotation about said torque axis of said housing means, except for said innermost kelly section each one of said kelly sections is operable for rotating an inwardly adjacent kelly section, each one of said kelly sections having an axis in axial alignment with said torque axis, said innermost kelly section having a bottom part adaptable for coupling to an auger; and torque coupling means rigidly connected to said torque transfer channel of said torque transmission means and rigidly connected to said outermost kelly section, said torque coupling means having a coupling passageway intended for means intended to be swivelly connected to said innermost kelly section for retracting said plurality of kelly sections into said reaction torque housing means.

26. The augering apparatus of claim 25, wherein said downcrowd means does not substantially increase the longitudinal length of said augering apparatus in the direction of said torque axis.

27. A downcrowdable telescopic drilling rig for drilling a hole in the surface of the earth, said drilling rig comprising:

a vehicle comprising crawler type tracks, a turntable, a boom pivotally connected to a horizontal shaft mounted on said turntable for elevational positioning of said boom, said turntable for azimuthal positioning of said boom, said boom having a distal end having a main pin traverse to said boom intended for pivotal connection of an earth excavating device, said vehicle also comprising longitudinal tilt hydraulic cylinder means for pivoting such device in the plane of the boom about said main pin;

yoke means having a main body, longitudinal bearing means rigidly attached to said main body and pivotally connected to said main pin of said boom, tilt bearing means rigidly attached to said main body and pivotally connected to said longitudinal tilt hydraulic cylinder means such that a predetermined amount of extension of said longitudinal tilt hydraulic cylinder means causes a predetermined amount of pivoting of said yoke means in the plane of said boom about said main pin of said boom, and traverse bearing means rigidly attached to said main body;

cradle means having an open-ended main frame having a longitudinal central cavity, traverse trunnion means rigidly attached to said mainframe and pivotally connected to said traverse bearing means of said yoke means, said traverse trunnion means and said traverse bearing means being operable for permitting said cradle means to be pivoted in a plane perpendicular to said plane of said boom, and receptacle means rigidly attached to said main frame;

traverse tilt hydraulic cylinder means for controlled pivoting of said cradle means relative to said yoke means in a plane perpendicular to said plane of said boom;

reaction torque housing means having an elongated principal body having a cylindrical inside surface which defines a torque axis and a top and a bottom, guide means rigidly fastened longitudinally on outside of said principal body and extending from proximate said top thereof to proximate said bottom thereof, said longitudinal central cavity of said cradle means for receiving said housing means, said guide means and said receptacle means of said cradle means being operable for permitting slidable displacement of said housing means relative to said receptacle means of said cradle means, said slidable displacement being in, and restricted to, a predetermined straight line direction in axial alignment with said torque axis;

downcrowd hydraulic cylinder means connected at one end thereof to said principal body of said housing means and connected at an opposite end thereof to said main frame of said cradle means, such that a predetermined amount of extension of said downcrowd hydraulic cylinder means causes a predetermined amount of straight line displacement of said housing means relative to said receptacle means of said cradle means in a direction in axial alignment with said torque axis of said housing means, said downcrowd hydraulic cylinder means having a predetermined maximum downcrowd stroke length;

torque transmission means having a transmission housing rigidly attached to said top of said principal body of said reaction torque housing means, angle drive means rotatably mounted in said transmission housing and having output gear means having an output power axis in axial alignment with said torque axis of said reaction torque housing means and input gear means having an input power axis at an angle to said output power axis, said input gear means being operable for driving said output gear means, said output gear means having an axial torque transfer channel extending axially through said output gear means and in axial alignment with said output power axis;

telescopic kelly means having a plurality of telescoping kelly sections which comprise at least an outermost kelly section and an innermost kelly section, said telescopic kelly means operable for being extended to a predetermined maximum telescopic length, said outermost kelly section having rigidly attached to the outside thereof a kelly bearing which is rotatably mounted in said cylindrical inside surface of said reaction torque housing means for rotation about an axis which is in axial alignment with said torque axis of said housing means, except for said innermost kelly section each one of said kelly sections is operable for rotating an inwardly adjacent kelly section, each one of said kelly sections having an axis in axial alignment with said torque axis of said housing means, said innermost kelly section having a bottom part adaptable for coupling to an auger;

torque coupling means for transmitting torque from said angle drive means to said outermost kelly section and for maintaining said outermost kelly section rotatably mounted in said reaction torque housing means, said torque coupling means having an upper part which is received in said torque transfer channel of said output gear means, said upper part and said torque transfer channel being operable for causing said torque coupling means to rotate with the rotation of said output gear means, said torque coupling means having a lower part rigidly connected to an upper part of said outermost kelly section, said torque coupling means having a coupling bore having an axis in axial alignment with said torque axis of said reaction torque housing means, whereby torque is transmitted from said output gear means to said torque coupling means and then to said outermost kelly section;

torque generator means for producing rotary power;

torque transfer means for transferring rotary power produced by said torque generator means to said input gear means of said torque transmission means whereby said torque generator means drives said torque transfer means which drives said input gear means of said torque transmission means;

flexible tension means swivelly connected at one end thereof to said innermost kelly section and connected at an opposite end thereof to winch means, said flexible tension means operable for passing through said coupling bore of said torque coupling means; and winch means for winching up said flexible tension means thereby retracting said plurality of kelly sections into said reaction torque housing means, said winch means being rigidly attached to said reaction torque housing means, said drilling rig being operable for extending a longitudinal distance along said torque axis approximately equal to the sum of said maximum downcrowd stroke length and said maximum telescopic length, whereupon coupling an auger to said bottom part of said innermost kelly section and positioning said drilling rig so that said torque axis is aligned with the axis of a hole to be drilled, such a hole can be drilled at a preselected drill site to a depth approximately equal to said longitudinal distance.

28. The drilling rig of claim 27, wherein said boom is telescopic.

29. A downcrowdable telescopic augering apparatus for drilling a hole in the surface of the earth comprising:

cradle means having a longitudinal central cavity;

reaction torque housing means having a cylindrical inside surface which defines a torque axis, said longitudinal central cavity of said cradle means for receiving said housing means;

means for permitting slidable displacement of said housing means relative to said cradle means in, and restricted to, a predetermined straight line direction in axial alignment with said torque axis;

downcrowd means for downcrowding said housing means relative to said cradle means in said predetermined straight line direction;

torque transmission means rigidly attached to said reaction torque housing means, said torque transmission means adaptable for receiving torque from a source of rotary power along an input power axis at an angle to said torque axis and transmitting torque in axial alignment with said torque axis;

telescopic kelly means having a plurality of telescoping kelly sections which comprise at least an outermost kelly section and an innermost kelly section, said outermost kelly section being rotatably mounted in said reaction torque housing means for rotation about said torque axis of said housing means, except for said innermost kelly section each one of said kelly sections is operable for rotating an inwardly adjacent kelly section, each one of said kelly sections having an axis in axial alignment with said torque axis, said innermost kelly section having a bottom part adaptable for coupling to an auger;

torque coupling means for transmitting torque from said torque transmission means to said outermost kelly section; and means for retracting said plurality of kelly sections into said reaction torque housing means.

30. The augering apparatus of claim 29, wherein said downcrowd means does not substantially increase the longitudinal length of said augering apparatus in the direction of said torque axis.

31. A downcrowdable telescopic augering apparatus for drilling a hole in the surface of the earth comprising:

cradle means having a longitudinal central cavity;

housing means having a cylindrical inside surface which defines a torque axis, said longitudinal central cavity of said cradle means for receiving said housing means;

means for permitting slidable displacement of said housing means relative to said cradle means in, and restricted to, a predetermined straight line direction in axial alignment with said torque axis;

downcrowd means for downcrowding said housing means relative to said cradle means in said predetermined straight line direction;

torque transmission means rigidly attached to said reaction torque housing means, said torque transmission means adaptable for receiving torque from a source of rotary power along an input power axis at an angle to said torque axis and transmitting torque in axial alignment with said torque axis;

telescopic kelly means having a plurality of telescoping kelly sections, said kelly means being rotatably mounted in said housing means for rotation about said torque axis thereof, said kelly means having a bottom part adaptable for coupling to an auger;

torque coupling means for transmitting torque from said torque transmission means to said kelly means; and means for retracting said kelly means into said reaction torque housing means.

32. The augering apparatus of claim 31, wherein said downcrowd means does not substantially increase the vertical height of said augering apparatus when it is used to drill a vertical hole.

* * * * *